US011982161B2

(12) United States Patent
Donald et al.

(10) Patent No.: US 11,982,161 B2
(45) Date of Patent: May 14, 2024

(54) APPARATUS, SYSTEMS AND METHODS FOR OIL AND GAS OPERATIONS

(71) Applicant: Enpro Subsea Limited, Aberdeenshire (GB)

(72) Inventors: Ian Donald, Inverurie (GB); John Reid, Perthshire (GB); Craig McDonald, Aberdeenshire (GB)

(73) Assignee: Enpro Subsea Limited, Aberdeen (GB)

( * ) Notice: Subject to any disclaimer, the term of this patent is extended or adjusted under 35 U.S.C. 154(b) by 345 days.

(21) Appl. No.: 17/420,956

(22) PCT Filed: Jan. 30, 2020

(86) PCT No.: PCT/GB2020/050222
§ 371 (c)(1),
(2) Date: Jul. 6, 2021

(87) PCT Pub. No.: WO2020/157509
PCT Pub. Date: Aug. 6, 2020

(65) Prior Publication Data

US 2022/0090471 A1 Mar. 24, 2022

(30) Foreign Application Priority Data

Jan. 30, 2019 (GB) ..... 1901257

(51) Int. Cl.
*E21B 43/013* (2006.01)

(52) U.S. Cl.
CPC ..... *E21B 43/013* (2013.01)

(58) Field of Classification Search
CPC ... E21B 43/013; E21B 43/017; E21B 43/0175
See application file for complete search history.

(56) References Cited

U.S. PATENT DOCUMENTS 8,550,170 B2 10/2013 McHugh et al.
9,963,956 B2 * 5/2018 Vilstrup ..... E21B 43/12
10,947,803 B2 3/2021 Riley et al.
(Continued)

FOREIGN PATENT DOCUMENTS

EP 3279429 A1 2/2018
EP 3440307 A1 2/2019
(Continued)

OTHER PUBLICATIONS

International Searching Authority, Indian Patent Office, International Search Report and Written Opinion for PCT/GB2021/050902, date mailed: Jul. 29, 2021, 10 pages.

*Primary Examiner* — Benjamin F Fiorello
(74) *Attorney, Agent, or Firm* — Holzer Patel Drennan

(57) ABSTRACT

The invention provides a subsea in-line tee arrangement for a subsea production system comprising at least one removable module. The removable module is configured to be assembled with a jumper flowline and provide flow access between a jumper flowline and the subsea in-line tee. At least one retrievable process apparatus can be connected to the retrievable module. The at least one retrievable process apparatus is configured to perform a function selected from the group comprising: fluid control, fluid sampling, fluid diversion, fluid recovery, fluid injection, fluid circulation, fluid measurement and/or fluid metering.

22 Claims, 20 Drawing Sheets

(56) References Cited

U.S. PATENT DOCUMENTS

| | | | | |
|---|---|---|---|---|
| 11,053,746 | B2 * | 7/2021 | Rageot | F17D 3/01 |
| 11,391,124 | B2 * | 7/2022 | Donald | E21B 43/017 |
| 11,480,043 | B2 * | 10/2022 | Rodrigues | E21B 43/129 |
| 2004/0144543 | A1 * | 7/2004 | Appleford | E21B 43/36 166/336 |
| 2010/0059221 | A1 * | 3/2010 | Vannuffelen | E21B 49/081 166/264 |
| 2011/0155385 | A1 | 6/2011 | Haaheim | |
| 2013/0121212 | A1 | 5/2013 | Guha et al. | |
| 2013/0206420 | A1 * | 8/2013 | McHugh | E21B 43/12 166/351 |
| 2014/0112803 | A1 * | 4/2014 | Hallset | F04D 13/00 417/372 |
| 2014/0262306 | A1 * | 9/2014 | Hosie | E21B 47/001 166/359 |
| 2017/0067311 | A1 * | 3/2017 | Donald | E21B 33/038 |
| 2018/0016877 | A1 * | 1/2018 | Radicioni | E21B 43/017 |
| 2018/0030796 | A1 * | 2/2018 | Kalia | E21B 43/12 |
| 2020/0123867 | A1 * | 4/2020 | Riley | E21B 33/0355 |

FOREIGN PATENT DOCUMENTS

| | | | |
|---|---|---|---|
| EP | 3719249 | A1 | 10/2020 |
| GB | 2281925 | A | 3/1995 |
| GB | 2487578 | B | 6/2013 |
| GB | 2549102 | A | 10/2017 |
| WO | 2004085789 | A2 | 10/2004 |
| WO | 2013121212 | A2 | 8/2013 |
| WO | 2013126592 | A2 | 8/2013 |
| WO | 2016097717 | A2 | 6/2016 |
| WO | 2017209728 | A1 | 12/2017 |
| WO | 2019008435 | A1 | 1/2019 |
| WO | 2019115383 | A1 | 6/2019 |
| WO | 2020120964 | A1 | 6/2020 |
| WO | 2021209754 | A1 | 10/2021 |

* cited by examiner

APPARATUS, SYSTEMS AND METHODS FOR OIL AND GAS OPERATIONS

The present invention relates to apparatus, systems and methods for oil and gas operations, in particular to apparatus, systems and methods for providing fluid control, and/or performing measurement and/or intervention in oil and gas production or injection systems. The invention has particular application to subsea oil and gas operations, and aspects of the invention relate specifically to apparatus, systems and methods for fluid control, measurement and/or intervention in subsea oil and gas manifolds, in particular, in subsea in-line tees.

BACKGROUND TO THE INVENTION

In the field of subsea engineering for the hydrocarbon production industry, it is known to provide flow systems comprising manifolds. A subsea manifold may be connected to one or more flowlines coming from or going to other flow infrastructure within the flow system.

One type of subsea manifold is a well gathering manifold. This can accommodate numerous subsea wells at once and often also has additional functionality. An alternative type of subsea manifold is an in-line tee. An in-line tee is a piece of infrastructure which can be incorporated into a pipeline or a flowline to create a branched tie-in point for an additional pipeline or flowline. For example, an in-line tee may provide a tie-in point to a main production flowline for a flowline carrying production fluids from a subsea well.

The term "subsea manifold" may also be used more generally to refer to a subsea well gathering system. A subsea well gathering system is a subsea flow system into which production flow from one or more subsea wells is directed or which has the capacity to receive production flow from one or more subsea wells.

During the development of subsea hydrocarbon fields, it is often the case that new hydrocarbon discoveries are made and/or further tie-ins to the flow system infrastructure are required. As such, one or more in-line tees may be provided on the flow system to accommodate future tie-in requirements. If an in-line tee tie-in point is not immediately required, the branched tie-in point may be provided with a flow cap to shut it off, such that the pipeline can function as normal until such time that the tie-in point is required.

Providing in-line tees on the flow system to meet current and future well tie-in requirements will bring initial expenditure down, because in-line tees are generally less expensive than the typical well-gathering manifolds that can accommodate numerous wells at once. However, a collection of numerous in-line tees can function in the same manner as a conventional well gathering manifold, but instead distributed over a pipeline system. They therefore provide a distributed manifold system which can be selectively populated and utilised as and when project requirements demand. This can also lead to cost savings in the future. For example, reduced drilling costs because the top-hole can be drilled in an optimal position and served by one of several in-line tees; whereas typically, top-hole location is influenced by the fixed location of existing subsea infrastructure.

In-line tees are fully equipped with the equipment, instrumentation and valving needed to facilitate the tie-in and production of one or more the future wells. Whatever the type of subsea manifold, if the internal equipment, instrumentation and/or valving within the manifold is to fail, in order to repair or replace these parts the entire manifold must be recovered. This typically requires large vessels, is expensive, disruptive and potentially damaging to the surrounding subsea infrastructure, and disruptive to production operations.

SUMMARY OF THE INVENTION

It is amongst the aims and objects of the invention to provide a subsea in-line tee arrangement and method of use which mitigates drawbacks of prior art subsea in-line tees and methods of use.

It is amongst the aims and objects of the invention to provide an apparatus, system and a method of use for providing fluid control, fluid measurement and/or intervention in a flow system of an oil and gas production installation—for example, in a subsea manifold such as an in-line tee—which is an alternative to the apparatus and methods described in the prior art.

It is amongst the aims and objects of the invention to provide an apparatus, system and a method of use for providing fluid control, fluid measurement and/or intervention in an oil and gas production installation, which addresses one or more drawbacks of the prior art.

An object of the invention is to provide a flexible apparatus, system and method of use suitable for use with and/or retrofitting to industry standard or proprietary oil and gas system infrastructure including subsea manifolds, and in particular in-line tees.

Further objects and aims of the invention will become apparent from the following description.

According to a first aspect of the invention, there is provided a subsea in-line tee arrangement configured to be located in a subsea production pipeline of a subsea production system, the subsea in-line tee arrangement comprising:

a subsea in-line tee; and a removable module;

wherein the removable module comprises at least one connector for connecting the module to the in-line tee and an interface for connecting the module to at least one process apparatus; and wherein the removable module defines a flow path between the at least one connector and the interface.

The in-line tee may comprise an isolation valve.

The removable module may comprise an isolation valve.

The removable module may be configured to be assembled with a flowline jumper and may be configured to provide flow access between a jumper flowline and the subsea in-line tee. The removable module may be configured to provide direct flow access between a jumper flowline and the in-line tee via one or more flow paths in the removable module. Alternatively, or in addition, the removable module may be configured to provide flow access between a jumper flowline and the in-line tee via one or more process apparatus connected to the interface of the removable module.

The in-line tee may comprise a main body. The in-line-tee may comprise first and second connectors and may define a main flow path between the first and second connectors. The first and second connectors may be an inlet and an outlet for production flow from a main production flowline system, respectively, and may be configured to integrate the in-line tee into a pipeline. The main flow path of the in-line tee is may be continuous with the pipeline.

The in-line tee may further define one or more branched flow paths which may each be in fluid communication with the main flow path and one or more further connectors of the in-line tee. The one or more further connectors may define one or more branched tie-in points. The at least one connector of the removable module may be configured to be connected to a branched tie-in point of the in-line tee.

The interface may be configured to receive a process apparatus, or multiple process apparatus.

The removable module may be a flow access apparatus or a flow access hub, which may be configured to enable flow access to the subsea pipeline via the in-line tee.

The at least one connector of the removable module for connecting the module to the in-line tee may be a first connector. The flow path defined between the at least one connector (in other words, the first connector) and the interface may be a first flow path. The first flow path may comprise an isolation valve. The interface may be a single bore interface The removable module may further comprise a second connector. The second connector may be for connecting the module to a flowline, such as a jumper flowline. The removable module may be a part of a flowline jumper system, and therefore may be within the jumper envelope. The removable module may therefore be a flow access apparatus or flow access hub that can be deployed with the jumper system and/or retrieved from the in-line tee and subsea flow system with the jumper system, without causing disruption to the in-line tee or the wider flow system. The second connector may be configured to receive production fluid from a subsea well. The removable module may further define a second flow path between the second connector and the interface. The second flow path may comprise an isolation valve. The interface may be a dual bore interface.

Alternatively, the interface may be a multi-bore interface.

The removable module may comprise one or more control lines, which may be hydraulic, electrical and/or fibreoptic control lines. The removable module may comprise a control interface, which may include connection points for the one or more control lines. The control interface may be configured to connect to a similar control interface of a process apparatus. The one or more control lines may be connected to, and supplied from, an umbilical. The one or more control lines may be affixed to the removable module, or may be integrated internally.

The process apparatus may be a functional module, and may be configured to perform one or more functions selected from the group comprising: fluid control, fluid sampling, fluid diversion, fluid recovery, fluid injection, fluid circulation, fluid access, fluid measurement, flow measurement and/or fluid metering. The removable module may comprise a flow loop.

The process apparatus may be configured to perform one or more functions selected from the group comprising: fluid control, fluid sampling, fluid diversion, fluid recovery, fluid injection, fluid circulation, fluid access, fluid measurement, flow measurement and/or fluid metering. The process apparatus may comprise a flow loop.

The process apparatus may comprise a choke valve, which may be a production choke valve.

The term fluid encompasses references to liquid and/or gas and/or a combination.

According to a second aspect of the invention, there is provided a subsea in-line tee arrangement configured to be located in a subsea production pipeline of a subsea production system, the subsea in-line tee arrangement comprising:

a subsea in-line tee;

a removable module; and at least one process apparatus;

wherein the removable module comprises at least one connector for connecting the module to the in-line tee and an interface for connecting the module to the at least one process apparatus;

wherein the removable module defines a flow path between the at least one connector and the interface; and wherein the at least one process apparatus is configured to perform one or more functions selected from the group comprising: fluid control, fluid sampling, fluid diversion, fluid recovery, fluid injection, fluid circulation, fluid access, fluid measurement, flow measurement and/or fluid metering.

The subsea in-line tee may comprise an isolation valve.

Where the subsea in-line tee comprises an isolation valve, the process apparatus may be configured to provide control to the isolation valve. The process apparatus may be connected to control lines which may be from a subsea umbilical. The control lines of the process apparatus may be connected to the isolation-valve of the in-line tee. The control lines may be electrical, hydraulic, The process apparatus may comprise a flow loop.

The process apparatus may comprise a choke valve, which may be a production choke valve.

Embodiments of the second aspect of the invention may include one or more features of the first aspect of the invention or its embodiments, or vice versa.

According to a third aspect of the invention, there is provided a subsea in-line tee configured for connection to a subsea production system, the subsea in-line tee comprising:

a main flow path configured to be continuous with a subsea production pipeline; and a connector;

wherein a branched flow path is defined between the main flow path and the connector; and wherein the connector is configured for connecting the in-line tee to a removable module, a process apparatus and/or a subsea manifold such as a subsea Christmas tree or a subsea well gathering manifold.

The subsea production pipeline may carry production flow from one or more subsea wells.

The subsea in-line tee may be configured to receive production fluid from one or more additional subsea wells. The subsea in-line tee may be configured to route the production fluid from one or more additional subsea wells into the subsea production pipeline, such that the production flow from one or more subsea wells and the production fluid from one or more additional subsea wells is commingled and flows together.

Preferably, the in-line tee is welded into a subsea production pipeline of the subsea production flow system, such that the in-line tee is integrated into the pipeline.

The in-line tee may further comprise a valve positioned in the branched flow path. The valve may be an isolation valve.

The in-line tee may be connected to a removable module directly, or via a flowline such as a jumper flowline.

The in-line tee may be connected to a process apparatus directly, or via a flowline such as a jumper flowline.

Alternatively, the in-line tee may be connected to a subsea Christmas tree, a subsea manifold or one or more subsea wells via one or more flowlines.

Embodiments of the third aspect of the invention may include one or more features of the first or second aspects of the invention or their embodiments, or vice versa.

According to a fourth aspect of the invention there is provided a removable module for a subsea in-line tee of a subsea production system, the removable module comprising: at least one connector configured to connect the module to the subsea in-line tee; and an interface for connecting the module to the at least one process apparatus.

The removable module may be a flow access apparatus or a flow access hub, which may be configured to enable flow access to the subsea pipeline via the in-line tee.

Optionally, the removable module may also be configured to perform one or more functions selected from the group comprising: fluid control, fluid sampling, fluid diversion, fluid recovery, fluid injection, fluid circulation, fluid access, fluid measurement, flow measurement and/or fluid metering. The removable module may comprise a flow loop.

The removable module may define a flow path between the at least one connector and the interface. The at least one connector of the removable module for connecting the module to the in-line tee may be a first connector, and the flow path defined between the at least one connector (in other words, the first connector) and the interface may be a first flow path. The interface may be a single bore interface.

The removable module may further comprise a second connector. The second connector may be for connecting the module to a flowline, such as a jumper flowline. The second connector may be configured to receive production fluid from a subsea well. The removable module may further define a second flow path between the second connector and the interface. The second flow path may comprise an isolation valve. The interface may be a dual bore interface.

Alternatively, the interface may be a multi-bore interface.

The removable module may be a part of a flowline jumper system, and therefore may be within the jumper envelope. The removable module may therefore be a flow access apparatus or flow access hub that can be deployed with the jumper system and/or retrieved from the in-line tee and subsea flow system with the jumper system, without causing disruption to the in-line tee or the wider flow system.

Embodiments of the fourth aspect of the invention may include one or more features of the first to third aspects of the invention or their embodiments, or vice versa.

According to a fifth aspect of the invention, there is provided a subsea oil and gas production installation, the installation comprising:

- a subsea production system;
- a subsea in-line tee located in a subsea production pipeline;
- a removable module comprising a connector connected to a branched flow path of the in-line tee and an interface, and defining a flow path between the connector and the interface; and
- at least one process apparatus connected to the interface of the removable module;
- wherein the at least one process apparatus is configured to perform one or more functions selected from the group comprising: fluid control, fluid sampling, fluid diversion, fluid recovery, fluid injection, fluid circulation, fluid access, fluid measurement, flow measurement and/or fluid metering.

The removable module may be a flow access apparatus or a flow access hub, which may be configured to enable flow access to the subsea pipeline via the in-line tee.

The removable module may be a part of a flowline jumper system, and therefore may be within the jumper envelope. The removable module may therefore be a flow access apparatus or flow access hub that can be deployed with the jumper system and/or retrieved from the in-line tee and subsea flow system with the jumper system, without causing disruption to the in-line tee or the wider flow system.

Embodiments of the fifth aspect of the invention may include one or more features of the first to fourth aspects of the invention or their embodiments, or vice versa.

According to a sixth aspect of the invention, there is provided a method of installing a removable module to a pre-installed subsea in-line tee, the method comprising:

- providing a subsea in-line tee pre-installed into a subsea production system and comprising a connector;
- providing a removable module comprising at least one connector; and
- coupling the at least one connector of the removable module to the connector of the subsea in-line tee.

The removable module may be a part of a flowline jumper system, and therefore may be within the jumper envelope. The removable module may therefore be a flow access apparatus or flow access hub that can be deployed with and/or retrieved from the in-line tee and subsea flow system without causing disruption to the in-line tee or the wider flow system.

The method may comprise deploying the removable module subsea.

The subsea in-line tee may be integrated into and/or located in a subsea production pipeline.

The connector of the in-line tee may be connected to a pre-installed flow component. The method may comprise removing the pre-installed flow component from the connector of subsea in-line tee before the removable module is coupled to the in-line tee.

The pre-installed flow component may be a flow cap, a flowline, a flow module, a processing apparatus or alternative piece of equipment.

The at least one connector may be a first connector and the removable module may comprise a second connector which may be coupled to a jumper flowline and forming a jumper flowline and removable module assembly.

The method may comprise coupling the removable module and jumper flowline assembly to the connector of the subsea in-line tee.

The removable module may further comprise an interface which may be fluidly connected by at least one flow path to the first connector. The method may comprise connecting a process apparatus to the interface of the removable module.

Embodiments of the sixth aspect of the invention may include one or more features of the first to fifth aspects of the invention or their embodiments, or vice versa.

According to a seventh aspect of the invention, there is provided a method of installing a process apparatus to a pre-installed subsea in-line tee, the method comprising:

- providing subsea in-line tee pre-installed into a subsea production system and comprising a connector connected to a removable module;
- providing a removable module comprising a connector connected to the in-line tee and an interface, and defining a flow path between the connector and the interface; and
- connecting a process apparatus to the interface of the removable module.

Embodiments of the seventh aspect of the invention may include one or more features of the first to sixth aspects of the invention or their embodiments, or vice versa.

According to an eighth aspect of the invention, there is provided a subsea production pipeline, the pipeline comprising:

- an in-line tee located in the pipeline;
- wherein the in-line tee defines a main flow path continuous with the subsea production pipeline; and wherein the in-line tee further comprises a connector configured for connection to a removable module, and defines a branched flow path between the main flow path and the connector.

Embodiments of the eighth aspect of the invention may include one or more features of the first to seventh aspects of the invention or their embodiments, or vice versa.

According to a ninth aspect of the invention there is provided a subsea in-line tee arrangement for a subsea production flow system, the subsea in-line tee arrangement comprising:

a subsea in-line tee integrated into a subsea production flowline;

a removable module; and a gas lift apparatus;

wherein the removable module comprises at least one connector for connecting the module to the in-line tee and an interface for connecting the module to the gas lift apparatus;

wherein the removable module defines a flow path between the at least one connector and the interface; and wherein the gas lift apparatus is configured to inject gas into the subsea production flowline via the removable module.

The subsea in-line tee may be integrated into the pipeline at a position adjacent the base of a production riser. Alternatively, the subsea in-line tee may be configured to be coupled directly to the base of a production riser.

The in-line tee may comprise a main flow path which may be continuous with the production flowline into which it is integrated. The in-line tee may further comprise a branched flow path, which may be defined between the main flow path and a connector on the in-line tee. The at least one connector on the removable module may be removably connected to the connector on the in-line tee.

The gas lift apparatus may comprise an inlet for connection to one or more gas lift delivery lines. The gas lift apparatus may comprise an outlet connector. The outlet connector may be fluidly connected to the interface of the removable module. The gas lift apparatus may comprise a main flow bore, which may be defined between the inlet and the outlet connector and which may fluidly connect the inlet and the outlet connector. The main flow bore may comprise an injection check valve. The main flow bore may comprise an injection nozzle which may function to control injection of gas from the delivery line into the main flow path of the in-line tee. The main flow bore may comprise a valve which controls the inlet of gas into the flow system. The valve may be hydraulically actuated and may be contacted to an umbilical which may provide hydraulic control.

The gas lift apparatus may comprise a pressure and/or temperature transducer.

The removable module may be a part of a flowline jumper system, and therefore may be within the jumper envelope. The removable module may therefore be a flow access apparatus or flow access hub that can be deployed with and/or retrieved from the in-line tee and subsea flow system without causing disruption to the in-line tee or the wider flow system.

Embodiments of the ninth aspect of the invention may include one or more features of the first to eighth aspects of the invention or their embodiments, or vice versa.

According to a tenth aspect of the invention there is provided a method of performing a gas lift operation in a subsea flow system, the method comprising:

providing a subsea in-line tee arrangement according to a ninth aspect of the invention;

coupling the gas lift apparatus to at least one gas lift delivery line; and operating one or more valves in the gas lift apparatus to inject gas from the gas lift delivery line into the subsea production flowline, via the removable module.

Embodiments of the tenth aspect of the invention may include one or more features of the first to ninth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
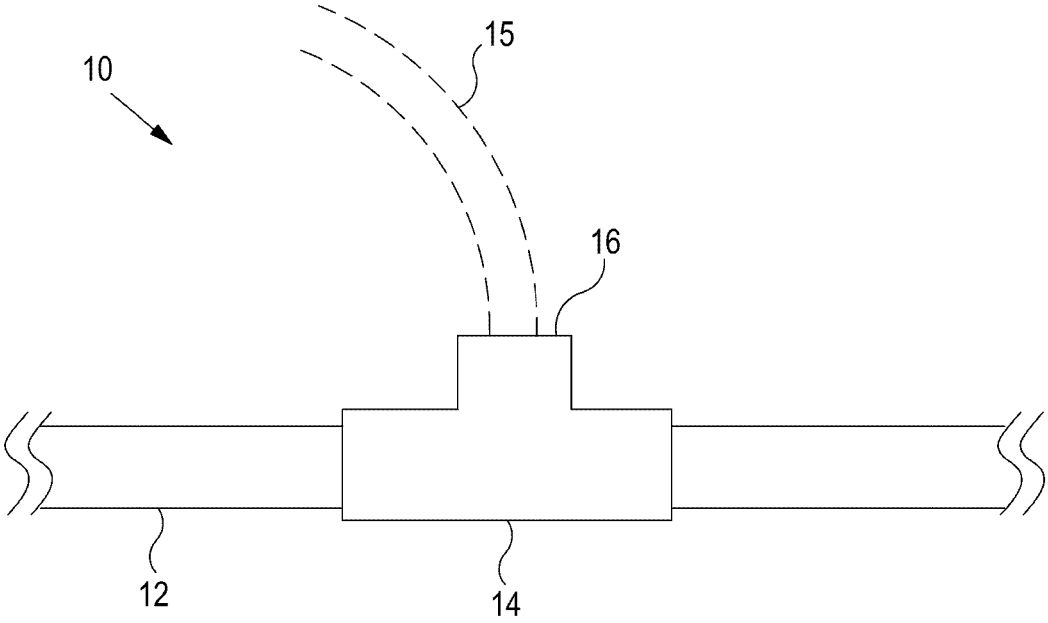
PRIOR ART FIG. 1
FIG. 1 is a schematic representation of an in-line tee in a flow system in an oil and gas production system.

Referring firstly to FIG. 1, there is shown, generally at 10, an aerial view of a section of subsea pipeline 12 forming part of a flow system in an oil and gas production system. An in-line tee 14 of the type known in the art is integrated into the pipeline 12 and provides a branched tie-in point 16 for a flowline 15 (shown with dashed lines). The tie-in point 16 may be connected to a flowline 15 during the installation of this subsea infrastructure. The flowline 15 is a full bore flowline having dimensions corresponding to that of the tie-in point. Alternatively, the tie-in point 16 may be initially capped in order to provide a tie-in location for a flowline 15 if and when this is required in the future.

Typical subsea in-line tees, like the kind shown in FIG. 1, tend to incorporate a number of valves, piping components and sensors in order to provide necessary flow control and monitoring functions. Although it would be desirable to provide in-line tees with additional functionality—including the ability to provide for and manage flow control, access and intervention operations (amongst other things)—this is not currently possible due to weight constraints.

In-line tees are subject to particularly strict size and weight constraints because they are assembled into the pipeline or sections of the pipeline (often by welding, although other connection methods may be used) prior to its installation subsea. Installation may be by any conventional, known pipe-lay methods including: S-lay, J-lay and reel-lay methods. What all of these pipe-lay methods have in common is that the assembled pipeline must be lowered from the pipe-lay vessel at sea level to the seabed. Therefore, the overall size and shape of an in-line tee must be restricted in order to allow it to be handled by conventional pipe-lay equipment such as tensioners. Additionally, the weight of an in-line tee must be constrained because this weight will act on the pipeline as it is lowered subsea.

Figure 2:
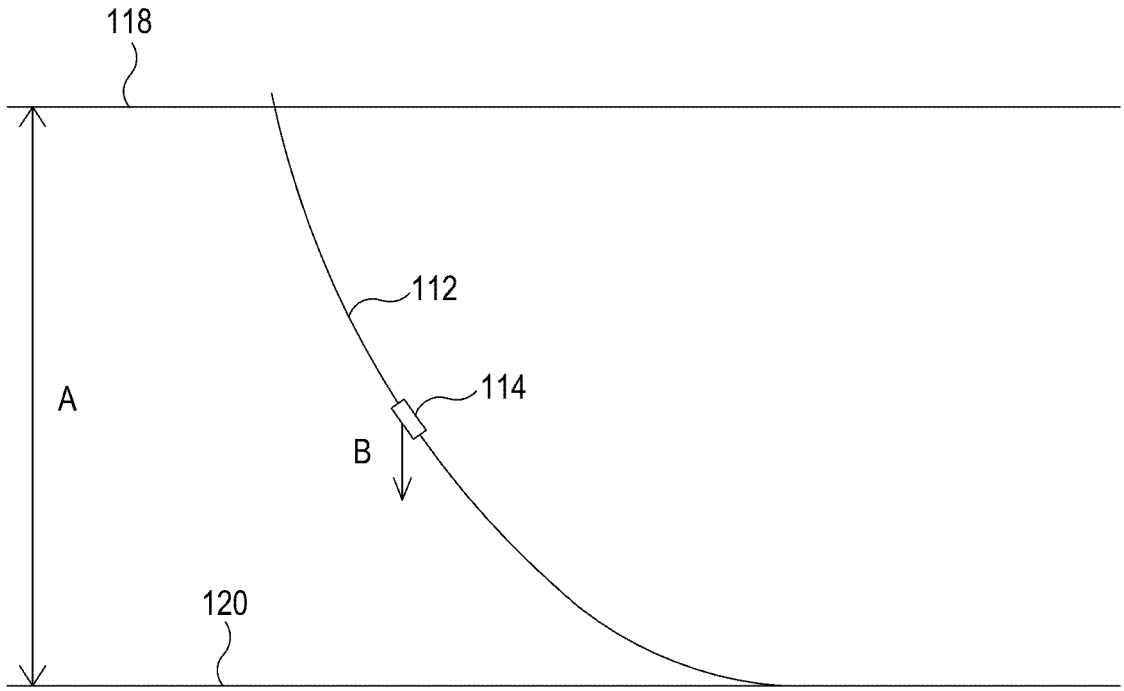
FIG. 2 is a schematic representation of the subsea pipe-lay of a pipeline comprising an in-line tee.

For example, with reference to FIG. 2 which is a schematic view of a subsea pipe-lay operation, the effect of an in-line tee on a pipeline during installation is shown. The pipeline 112 is lowered from sea level 118 to the seabed 120 by a pipe-lay vessel (not shown) using conventional methods. During the operation, part of the pipeline is suspended in the sea by a distance which is equivalent to the sea depth in the area of installation, shown by arrow A. In this example, an in-line tee 114 is welded into the pipeline prior to its deployment subsea, and is shown suspended on the pipeline 112 during pipe-lay. The weight of the in-line tee, signified generally by arrow B, stresses the pipeline whilst in suspension. This can have many damaging effects to the pipeline, including pipeline fatigue and stretching, which may be detrimental to the pipeline in the long term. The effect of this problem is worse when laying pipelines in deep water. Greater water depths mean that longer sections of pipeline are suspended in the sea during installation. As such, the in-line tee will be suspended on the pipeline for more time, meaning that a larger area of the pipeline is subjected to the weight of the in-line tee.

Figure 3A:
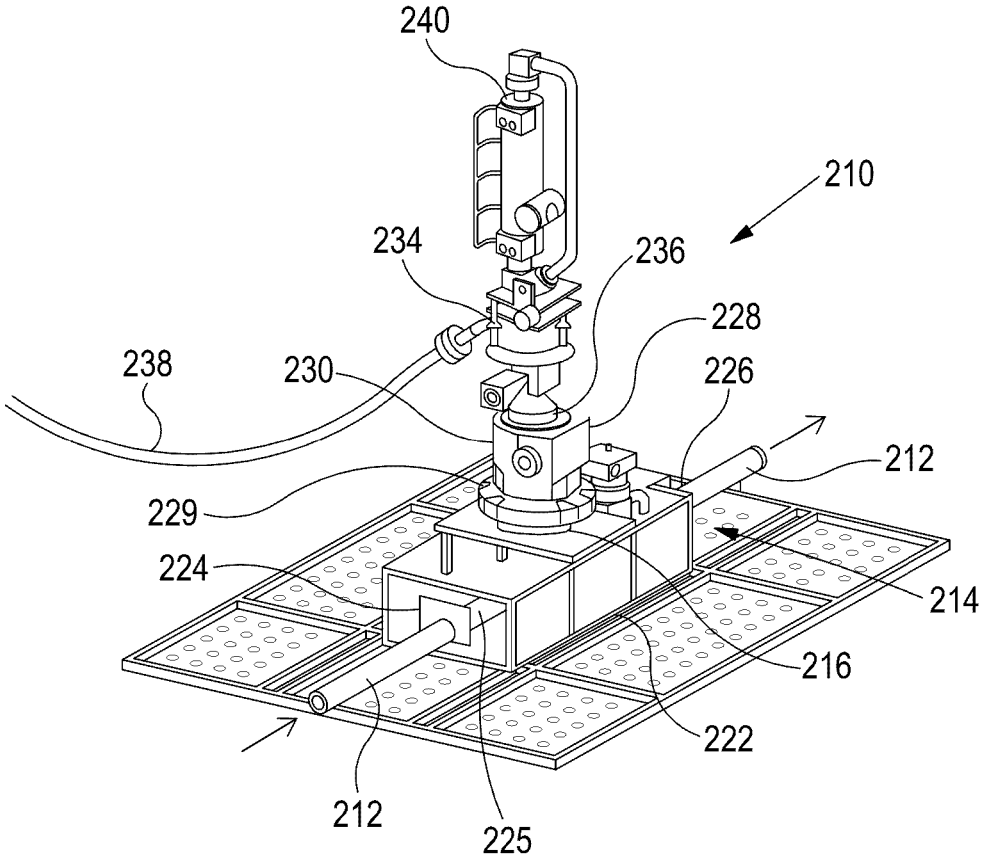
FIGS. 3A and 3B are perspective and schematic views, respectively, of an in-line tee arrangement according to a first embodiment of the invention.
Figure 3B:
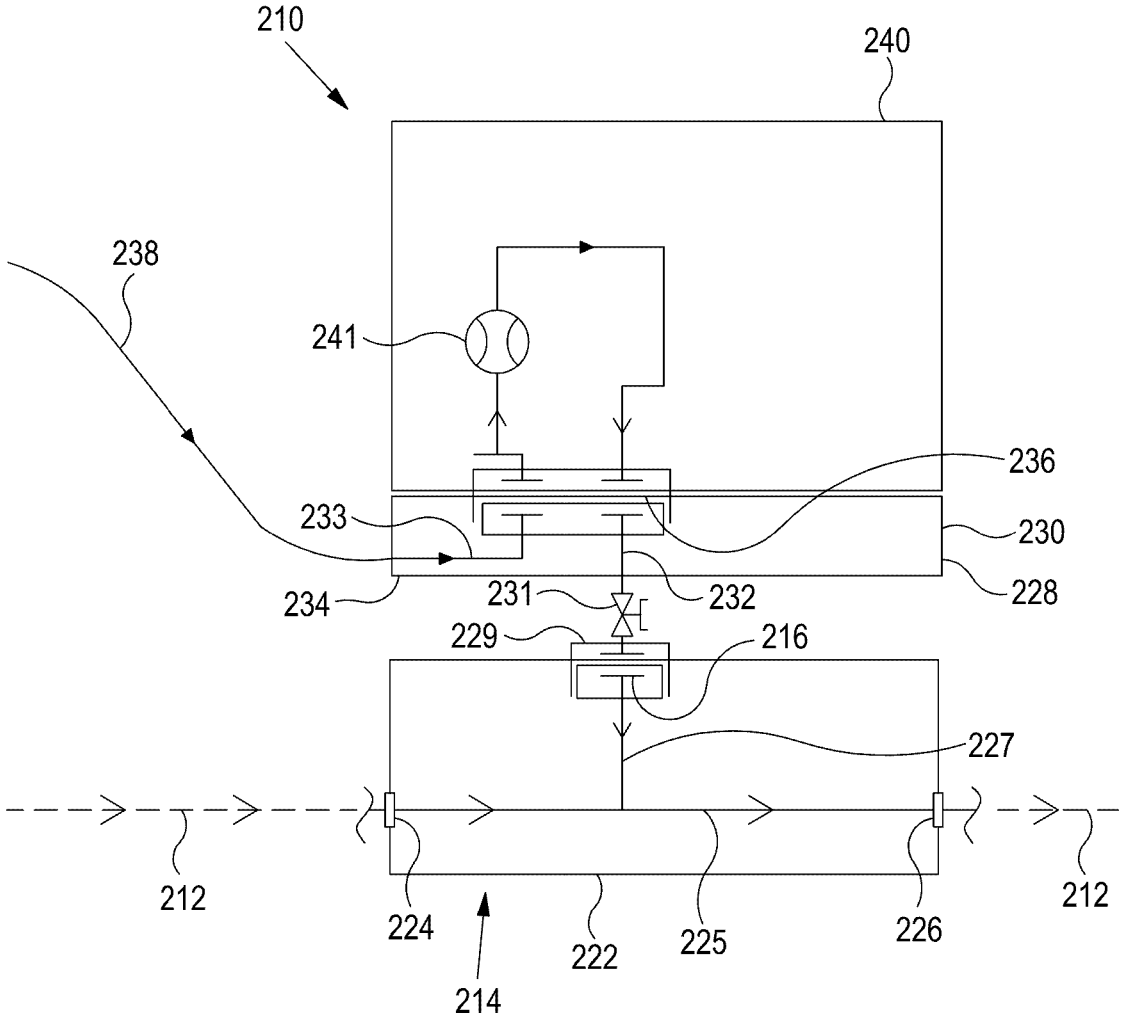

Referring now to FIGS. 3A and 3B, respective perspective and schematic views of a subsea flow system incorporating an in-line tee arrangement according to an embodiment of the invention are shown. The in-line tee arrangement is shown generally at 210.

The in-line tee 214 is a simplified in-line tee and comprises a main body 222, which defines a main flow through path 225 between connectors 224 and 226 (i.e. an inlet and an outlet). Connectors 224 and 226 integrate the in-line tee into a pipeline 212 (only part of which is shown in FIG. 3A and which is shown by dashed lines in FIG. 3B), such that the main flow path through the in-line tee is generally continuous with the pipeline. Although the connectors 224 and 226 are shown as being axially aligned, they may be offset in alternative embodiments of the invention. In this example, the pipeline 212 is a pipeline carrying production fluids from one or more subsea wells to a floating production storage and offloading installation (FPSO) in the direction indicated by the arrows. In this example, the in-line tee 214 is fully integrated into the pipeline by welding the pipeline 212 and connectors 224 and 226; however, it will be appreciated that any other suitable connection methods for integrating the in-line tee into the pipeline may be used.

The main flow path 225 of the in-line tee is continuous with the pipeline 212. The in-line tee 214 also defines a branched flow path 227 (see FIG. 3B) which is in fluid communication with the main flow path 225 and a connector of the in-line tee 214 which is in the form of branched tie-in point 216. In alternative embodiments of the invention, it will be appreciated that in-line tees may comprise additional branched flow paths and corresponding tie-in points.

A flow cap can be placed over the branched tie-in point 216 such that the tee 214 merely functions as an extension of the pipeline 212. This may be done, for example, when future field expansion is anticipated in order to provide a tie-in point for an additional subsea well that is expected to be required in the future. Although not shown in FIGS. 3A and 3B, the in-line tee also comprises one or more isolation valves located in the branched flow path 227.

FIGS. 3A and 3B show the in-line tee arrangement once in connection with, and receiving fluids from, an additional subsea well (not shown). A removable module 228 is provided on the in-line tee 214 via a connection made between a connector 229 of the module 228 and the tie-in point 216 of the in-line tee 214. The removable module 228 can be a flow access apparatus in the form of a dual bore access hub of the type described in the applicant's international patent publication number WO 2016/097717, and facilitates fluid intervention and/or flow access to the subsea well and/or production flow system through a single interface 236. Alternatively, or in addition, the removable module 228 can be a flow access apparatus in the form of an access hub of the type described in the applicant's international patent publication number WO 2013/121212. The removable module 228 comprises a main body 230 defining two flow paths 232 and 233 therethrough (as seen in FIG. 3B). The flow paths 232 and 233 are defined between two connectors 229 and 234 of the removable module 228, respectively, and the module interface 236. In this embodiment the module interface 236 is a dual bore interface. However, it will be appreciated that a single bore or a multi-bore removable module having a single bore or a multi-bore interface may similarly be provided.

For clarity, in the schematic view of FIG. 3B the connector 229 of the module 228 is shown as being positioned externally to the main body 230 of the module to clearly show the presence of an optional valve 231 in the flow path 232 of the module 228. The valve 231 is operable to selectively open and shut off access to the module 228 from the main flow path 225 of the in-line tee.

The flowline 238 is a jumper flowline, and the module 228 facilitates the connection of the jumper flow line 238 to the main production bore 212 via the relatively large bore size of the tie-in point of the in-line tee. The removable module 228 provides a convenient location to connect a jumper flowline to the tee to provide flexibility in field development and production by providing a flowline connector for a jumper flowline where one did not previously exist. Furthermore, by providing a removable module as part of the flowline jumper system, in the flowline jumper envelope, the module 228, the jumper 238 and any process apparatus or apparatuses connected to the module, are detachable and retrievable from the main production flow system incorporating the in-line tee.

The module 228 provides a convenient single interface 236 for one or more removable and/or retrievable process apparatus to be landed on the module 228. The module 228 is therefore a convenient means for providing the simplified in-line tee with access to equipment incorporating the valves, piping components, sensors and/or other functional elements and instrumentation required to provide the necessary flow control and flow monitoring functions required by the in-line tee, all whilst preserving the original capability of the in-line tee to receive fluids from an additional flowline (such as an additional subsea well) via the branched tie-in point. The module 228 is also operable to provide access via its interface 236 to equipment which may provide the in-line tee with additional functionality, such as flow processing and intervention equipment.

The module 228 protects the in-line tee from damage that may be caused by impacts during connecting or disconnecting various process apparatus and/or flowlines to the system, and/or from ongoing loads from these components following their installation. This is a benefit of the module 228. As the module 228 is provided within the jumper envelope (i.e. in the flowline jumper system) its retrieval and replacement, for example if damaged, is a substantially more cost-effective, simpler and less disruptive procedure than replacement or repair of the in-line tee, and does not require production shut down from upstream production wells.

In the embodiment shown in FIGS. 3A and 3B, the flow access module 228 receives production fluid from the additional subsea well (not shown) via the jumper flowline 238. Production fluid from the additional well is routed through the flow access module 228 via flow path 233 and into a process apparatus 240 which has been landed on the flow access interface 236 of the module 228. In the embodiment shown, the process apparatus 240 is a flow metering module. Production fluid travels through a flow loop in the module 240 (including flow meter 241) and back into the flow access module 228, into flow path 232. With the valve 231 of the flow access module 228 open, and the isolation valve in the flow path 227 of the in-line tee 214 also open (if present), production fluid from the tied-in subsea well is able to enter the in-line tee 214 via the tie-in point connection 216 and join the flow of production fluid within the main pipeline 212.

In the embodiment shown in FIGS. 3A and 3B, the process apparatus 240 contains a simple flow loop comprising a multiphase flow meter. In alternative embodiments of the invention, the process apparatus 240 may provide only a simple flow loop with no additional instrumentation. However, in further alternative embodiments of the invention, additional functionality may be provided by one or more process apparatus 240. For example, the removable module 228 may be configured to accommodate one or more process apparatus configured to perform a function selected from the group comprising: fluid control, fluid sampling, fluid diversion, fluid recovery, fluid injection, fluid circulation, fluid measurement and/or fluid metering. The one or more process apparatus 240 may be provided with their own interfaces to facilitate the stacking of further process apparatus on the assembly, if desired. When not connected to a process apparatus, the interface 236 of the removable module 228 may be blocked off by a simple flow cap.

By providing an in-line tee arrangement 210 comprising a simplified, stripped back in-line tee 214 and a removable module 228, a number of benefits are realised. Such benefits include a reduction in size of the in-line tee, a reduction in weight of the in-line tee and the optional ability to provide improved functionality to the in-line tee.

By removing the valves, piping components and sensors which are incorporated into a typical subsea in-line tee structure, a passive, simplified in-line tee structure which facilitates flow through in the usual manner is provided, which facilitates an optional additional tie-in point for a future subsea well (or other such flowline). Initial project expenditure is reduced by the ability to provide a simplified in-line tee only, having the option of adding greater future functionality by using a removable module and one or more process apparatus in the future, if required.

The cost-effective nature of the simplified in-line tees enables a greater number of multiple in-line tees to be provided in a pipeline. This facilitates the creation of multiple tie-in and/or flow access points for future use, with minimal disruption to the pipeline and additional flow infrastructure. When used to tie-in subsea wells and/or provide other flow access functions, a bundle of in-line tees can function like a conventional well gathering manifold, distributed over a pipeline system. They provide a distributed manifold which can be selectively populated and utilised as and when project requirements demand.

By integrating simplified in-line tees into the main flowline, with removable and process modules provided within a jumper flowline envelope system, all active components are made retrievable. In addition, the retrievable nature of the module 228 and the one or more process apparatus 240 means that they can be retrieved and replaced without disturbing the in-line tee itself, the main production flowline into which the in-line tee is integrated or yet further subsea infrastructure. It also facilitates a change in purpose or functionality and provides the flexibility to integrate emerging technologies into the flow system as and when they are developed in the future, which could aid with reservoir management and increased recovery.

The in-line tees are installed by pipe-lay vessel, and the removable modules are installed when they are required by RSV work vessel, or any other suitable vessel. This eliminates the requirement for heavy lift vessel mobilisation for subsea field construction. The removable modules can be subsequently retrieved and/or changed by a field work vessel.

Figure 6:
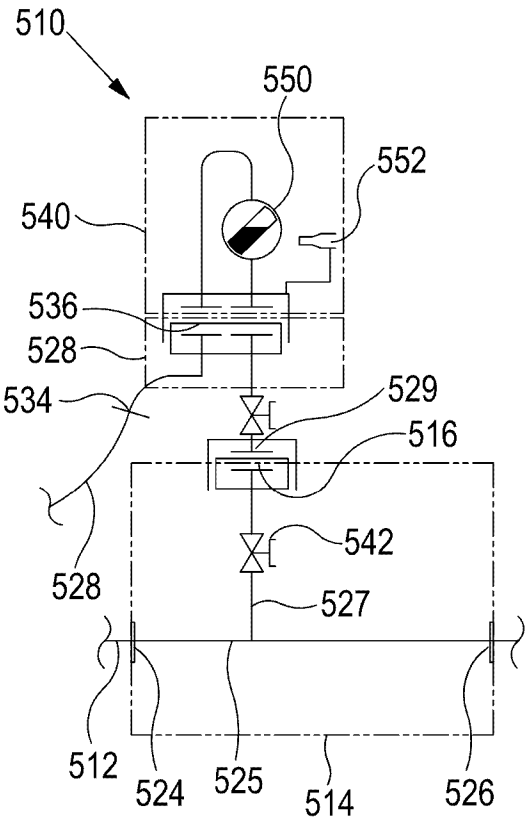
FIGS. 4, 5 and 6 are schematic views of in-line tee arrangements according to respective alternative embodiments of the invention.
Figure 5:
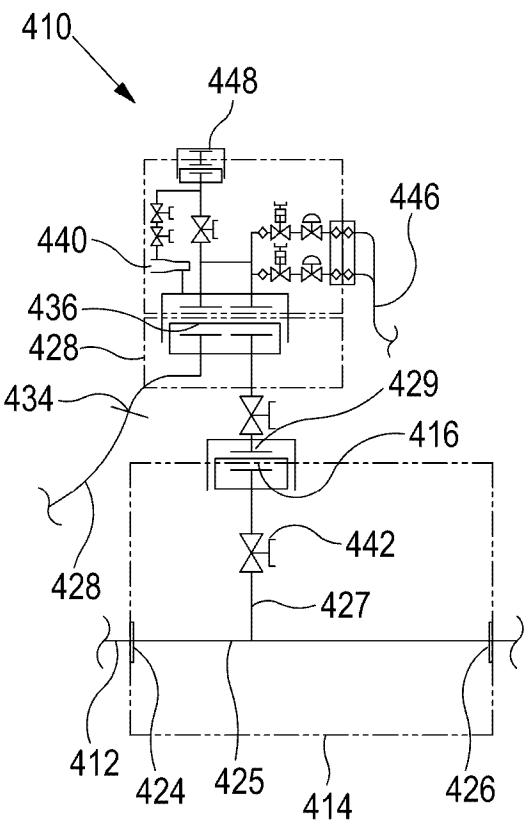
Figure 4:
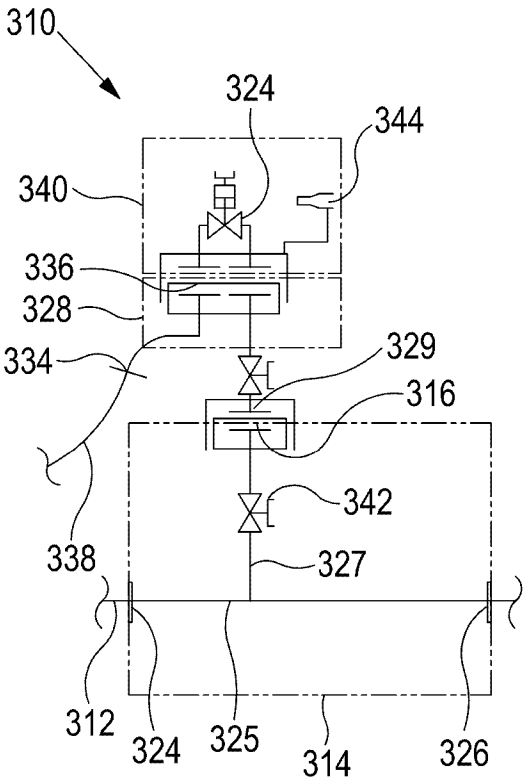

In-line tee arrangements provided with alternative process apparatus are shown in FIGS. 4, 5 and 6. The in-line tee arrangements 310, 410 and 510 are similar to the arrangement 210, and like components are indicated by like reference numerals incremented by 100, 200 and 300, respectively. The in-line tees 314, 414, 514 differ from the in-line tee 214 in that they comprise an isolation valve 342, 442, 542 in the branched flow path 327, 427, 527.

FIG. 4 shows an in-line tee arrangement including a valve apparatus 340. The valve apparatus 340 includes a valve 342 and an ROV hot stab connection 344. The valve 342 is hydraulically actuated via an umbilical (not shown). The hot stab connection 344 enables the performance of a connection test of the connection between the apparatus 340 and the interface 336 of the removable module 328. A process apparatus of this type may be provided as an additional safety barrier. For example, this might be required to meet certain project requirements.

FIG. 5 shows an in-line tee arrangement including a chemical injection apparatus 440, which is operable to receive fluids from a subsea distribution unit via flowline 446 for injection into the production system. The apparatus 440 also provides a point for hydraulic intervention 448.

FIG. 6 shows an in-line tee arrangement including a sampling apparatus 540 comprising one or more sampling bottles 550 and an ROV hot stab connection 552. The hot stab connection 552 enables the performance of a connection test of the connection between the apparatus 540 and the interface 536 of the removable module 528. This apparatus 540 is operable to collect samples of production fluid received from a tied-in subsea well (not shown) via flowline 538. This apparatus may be installed on the removable module 528 on a periodic basis, as and when samples are required.

Figure 7A:
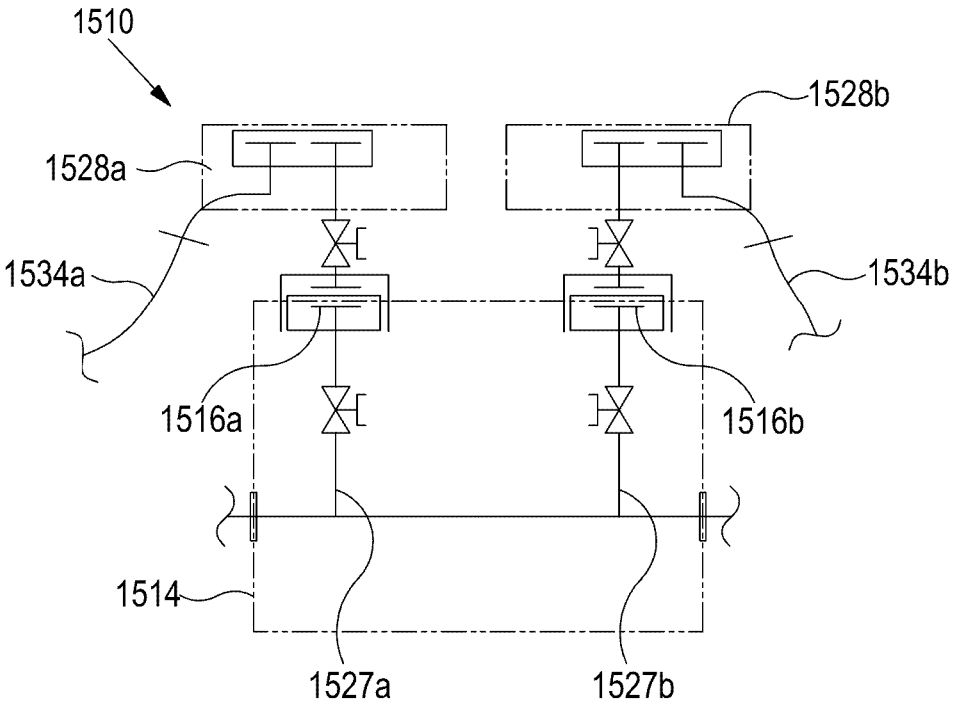
FIGS. 7A and 7B are schematic views of in-line tee arrangement according to an alternative embodiment of the invention.
Figure 7B:
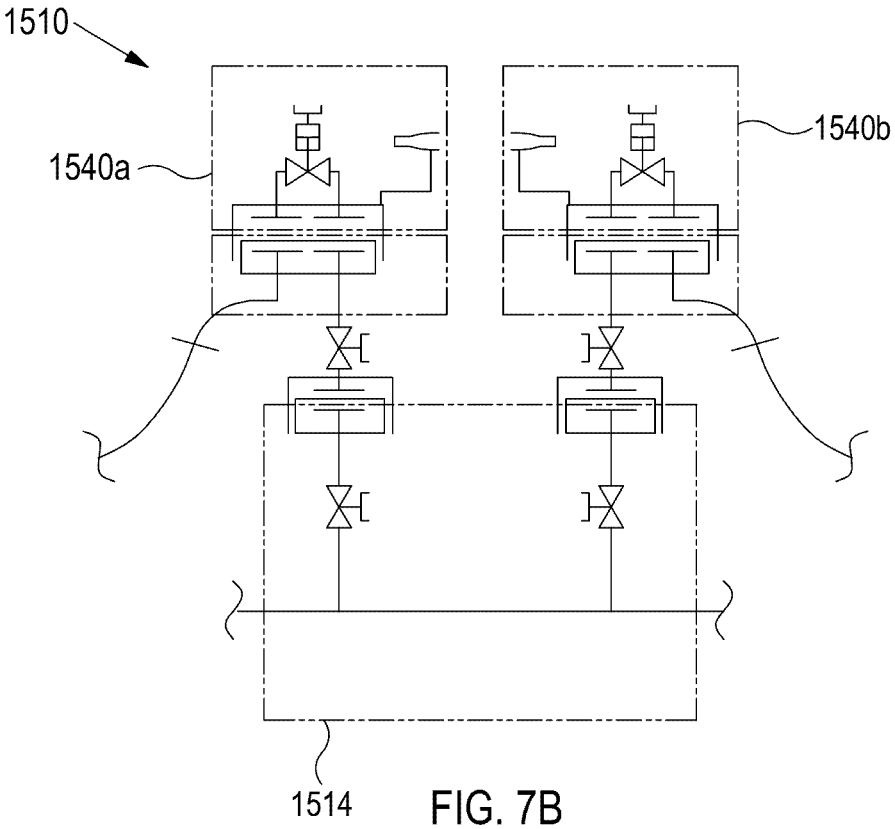

FIGS. 7A and 7B show an alternative in-line tee arrangement, shown generally at 1510. The in-line tee arrangement 1510 is similar to the foregoing inline tee arrangements 210, 310, 410 and 510 and like components are indicated by like reference numerals. The in-line tee 1514 differs from the in-lie tees shown in foregoing in-line tee arrangements as it defines two branched flow paths 1527*a* and 1527*b*, and thus provides two branched tie-in point connectors 1516*a* and 1516*b*. In FIG. 7A, each of these tie-in point connectors is shown with a removable module 1528*a*, 1528*b* mounted thereon. Although it will be appreciated that only one of the tie-in points may be utilised whilst the other is capped, or that either of the tie-in points may be selectively utilised at some point during the life span of the flow system. Each of the removable modules 1528*a* and 1528*b* are connected to a jumper flowline 1534*a* and 1534*b*, respectively, to receive production fluids from respective subsea wells.

FIG. 7B shows the same arrangement as FIG. 7A; however, in FIG. 7B process apparatus 1540*a* and 1540*b* have been connected to each of the removable modules 1528*a* and 1528*b*. Although the process apparatus in FIG. 7B are both the same (i.e. they are both valve apparatuses), it will be appreciated that different process apparatus may be connected to the respective removable modules at any one time.

Figure 8:
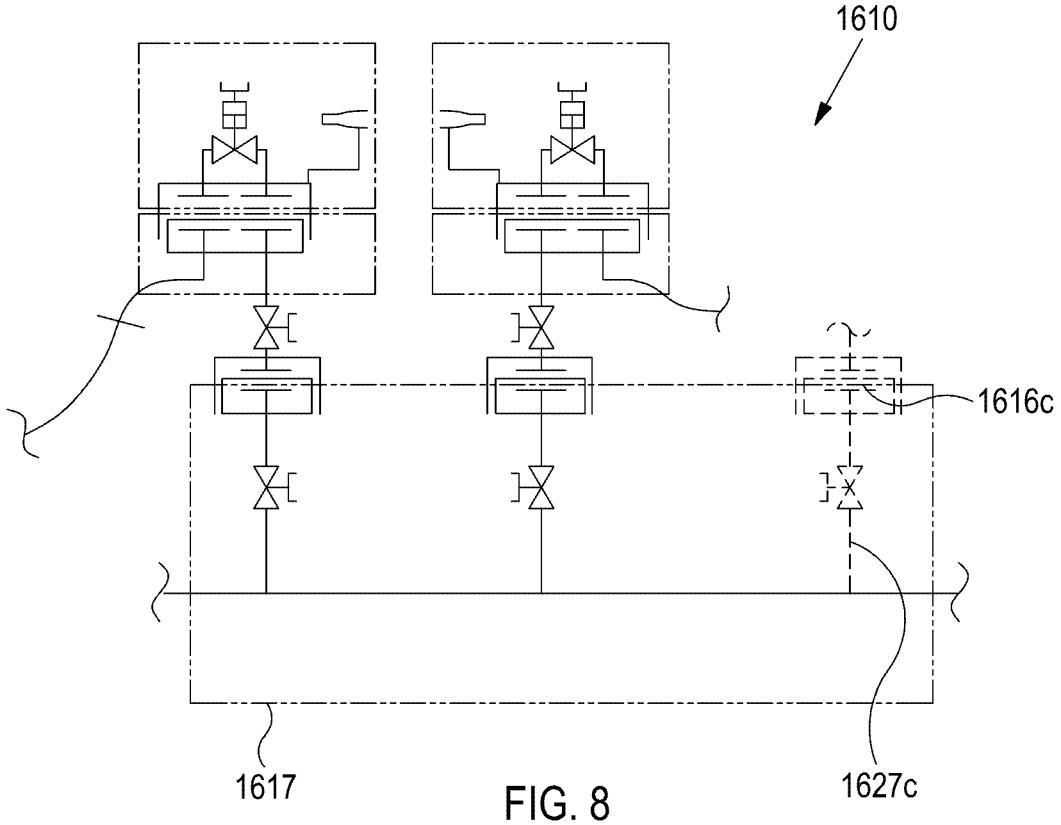
FIG. 8 is a schematic views of an in-line tee arrangement according to an alternative embodiment of the invention.

FIG. 8 shows yet a further alternative in-line tee arrangement, generally at 1610. Here, the in-line tee 1614 comprises a third branched flow path 1627*c* and a third branched tie-in point connector 1616*c*. It will be appreciated that alternative in-line tees within the scope of the invention could be provided with yet further branched flow paths and tie-in points. Alternatively, two or more standard in-line tees (like those shown in FIGS. 3A, 3B, 4, 5 and 6) could be connected to one another in succession or via intermediate flow system components to produce similar systems to the integrated double and triple in-line tees shown in FIGS. 7A, 7B and 8.

The installation and connection of an in-line tee arrangement subsea will now be described with reference to FIGS. 9A to 9E.

Figure 9A:
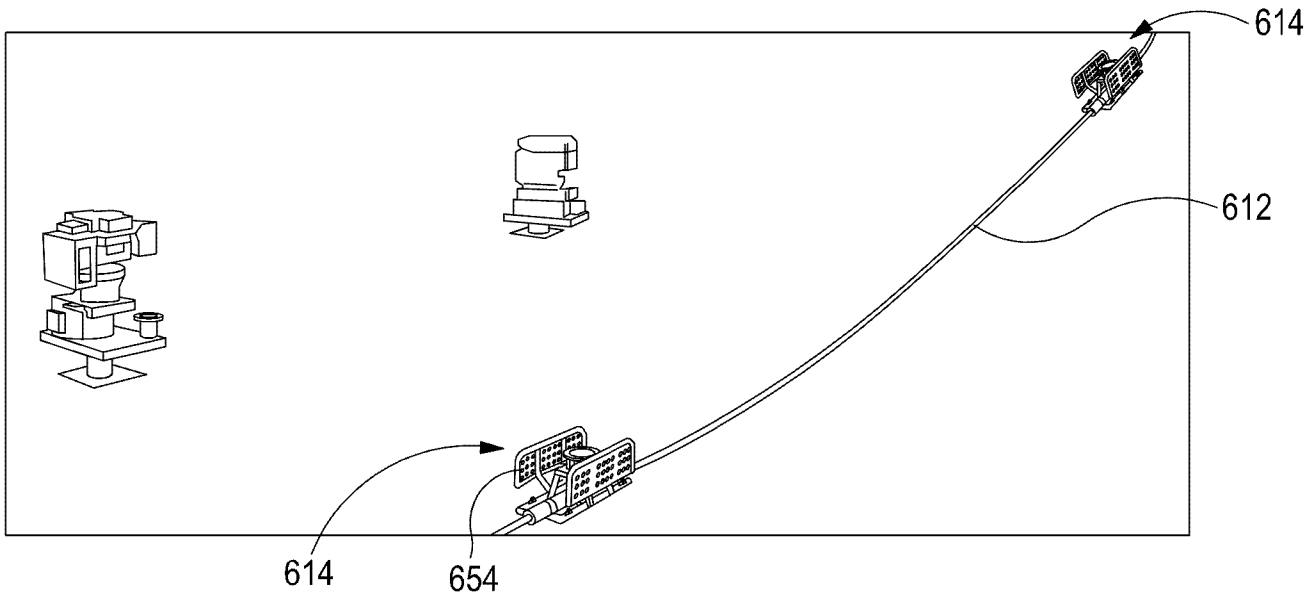
FIGS. 9A to 9E are perspective representations of a subsea installation sequence of an in-line tee arrangement according to an embodiment of the invention.

As described above, in-line tees are typically assembled into a pipeline (or sections of pipeline) prior to its installation subsea. FIG. 9A shows a pipeline 612 during subsea deployment. On the pipeline 612, two in-lie tees are pre-installed, shown generally at 614. Each in-line tee 614 comprises a fold out mud mat 654 which provides a foundation for each tee once it reaches the sea bed. As shown in FIG. 9A, the mud mats 654 are folded-up during deployment, as this is required to facilitate the initial movement of the in-line tee structures through the pipeline tensioners and other equipment on the pipe-lay vessel at the surface.

Figure 9B:
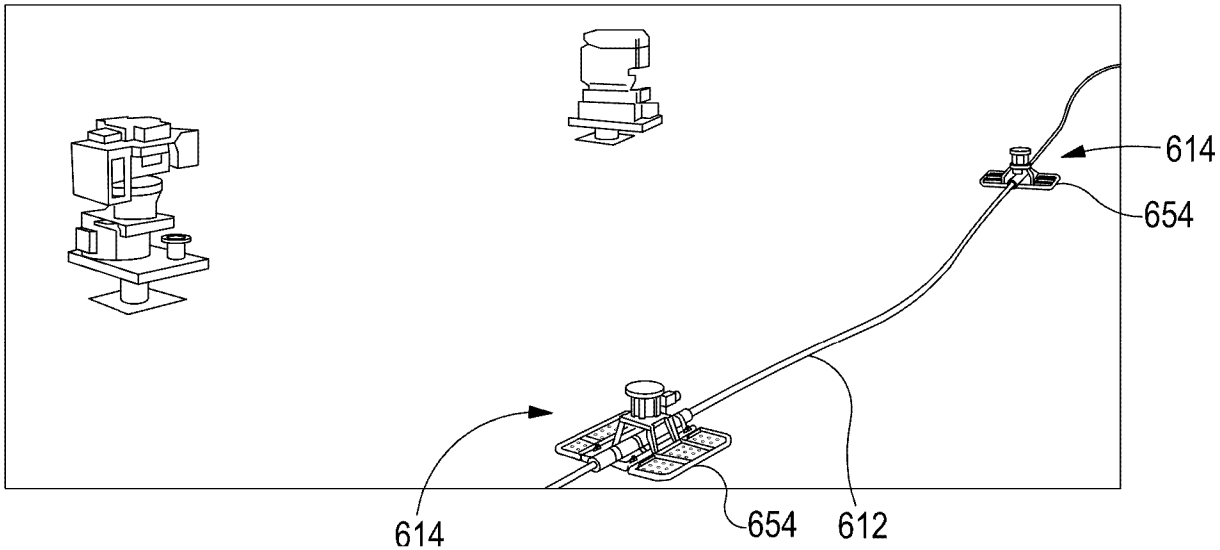

When installation of the pipeline 612 is complete, and confirmation is given that the in-line tees 614 are in their correct positions, the mud mats 654 can be folded out, as shown in FIG. 9B. The in-line tees are initially provided with flow caps (not shown) so that the pipeline can function normally.

Figure 9C:
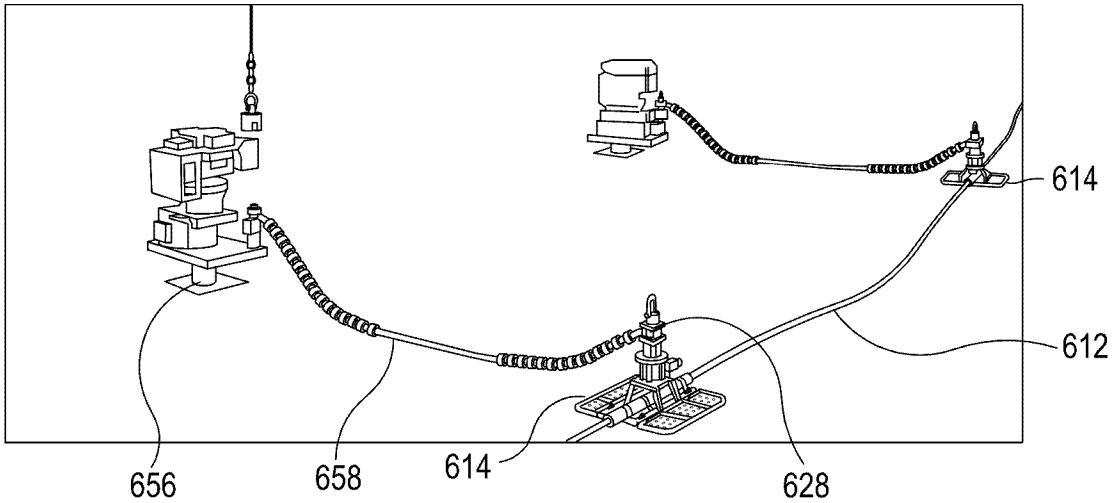

When it is time to connect a subsea well to an in-line tee, a removable module 628 and jumper flowline 658 assembly is deployed subsea. Locating the removable module 628 as part of the flowline jumper system (in the jumper flowline envelope) in this way provides a mechanism for the jumper flowline 658 to connect to the in-line tee and thus the flow system. The removable module is connected to the upper connector of the in-line tee 614 following deployment, and is initially provided with a flow cap or a flow loop apparatus (not shown) mounted thereon. As is shown in FIG. 9C, the opposite end of the jumper flowline is connected to a subsea Christmas tree 656, such that the module 628 (and hence the in-line tee 614) is operable to receive production fluid from the tree 656. In this example, a flexible jumper flowline is shown; however, it will be appreciated that alternative flowlines may be provided, such as a rigid jumper flowline.

If the removable module 628 is provided with a simple flow loop apparatus on its interface, the production fluid from the tree 656 is able to join that in the main production pipeline 612 via the in-line tee 614 and the jumper flowline and removable module 628 assembly, provided any valves within removable module 628 and/or the in-line tee 614 are open.

Figure 9D:
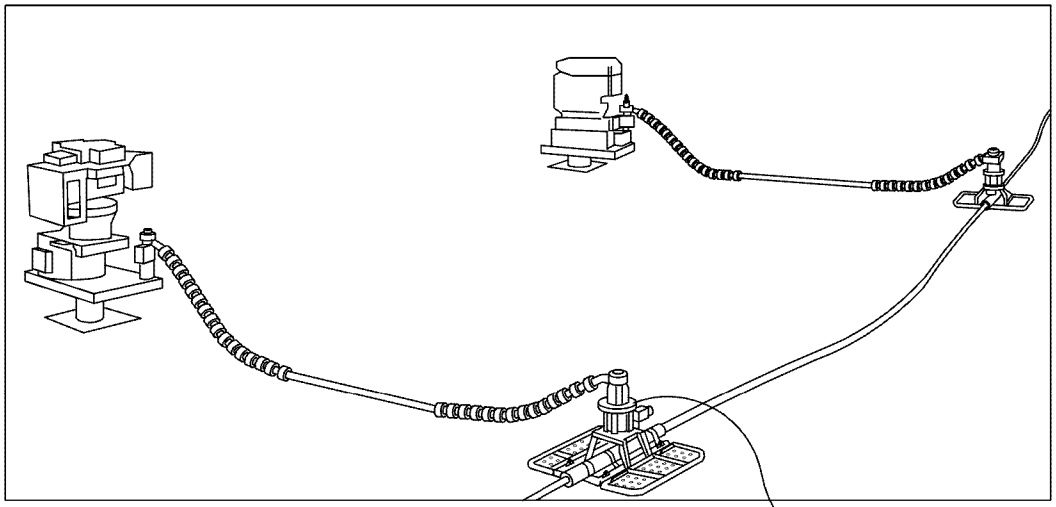

FIG. 9D shows the removable module 628 with its interface flow cap or flow loop apparatus removed. The flow cap or flow loop apparatus is removed in a step prior to landing a process apparatus on the interface of the removable module 628.

Figure 9E:
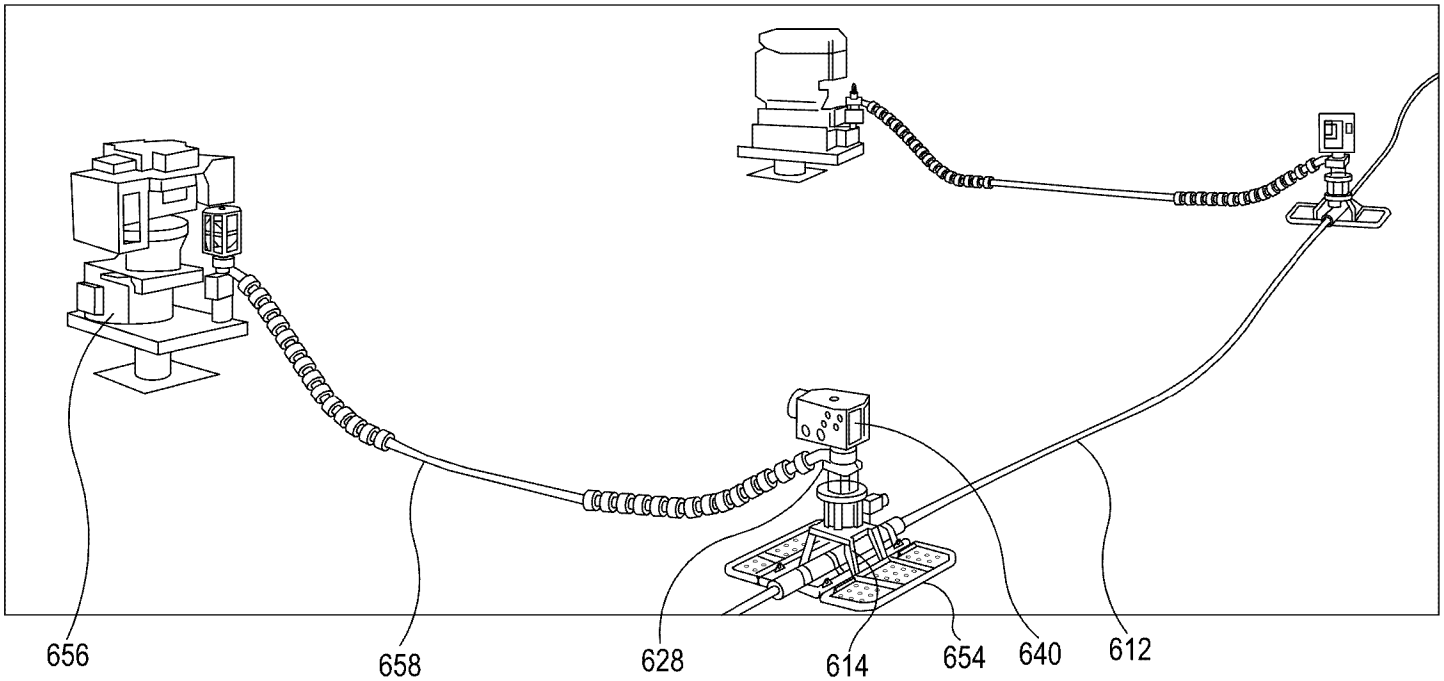

FIG. 9E shows a process apparatus 640 connected to the interface of the removable module 628 on the in-line tee 614. During installation, the removable module provided protection to the in-line tee from any impacts resulting from connection of the process apparatus. The removable module will continue to protect the in-line tee from loads, impacts and the like through its lifespan. In this embodiment, the process apparatus 640 is a flow meter and choke apparatus, comprising a multi-phase flow meter and a choke valve. Production fluid flows from the additional subsea well and into the removable module 628 via the Christmas tree 656 and jumper flowline 658. Flow is routed through the flow meter and choke apparatus 640, in which any desired flow monitoring and/or control steps may be performed. Upon exiting the apparatus 640, flow re-enters the removable module 628 before being routed through the in-line tee 614 to commingle with production fluid from one or more wells in the main production pipeline 612.

Although the foregoing description concerns the use of dual bore removable modules, which consequently provide a dual bore interface, it will be appreciated that the removable module may alternatively be a single or a multi bore module.

Figure 10A:
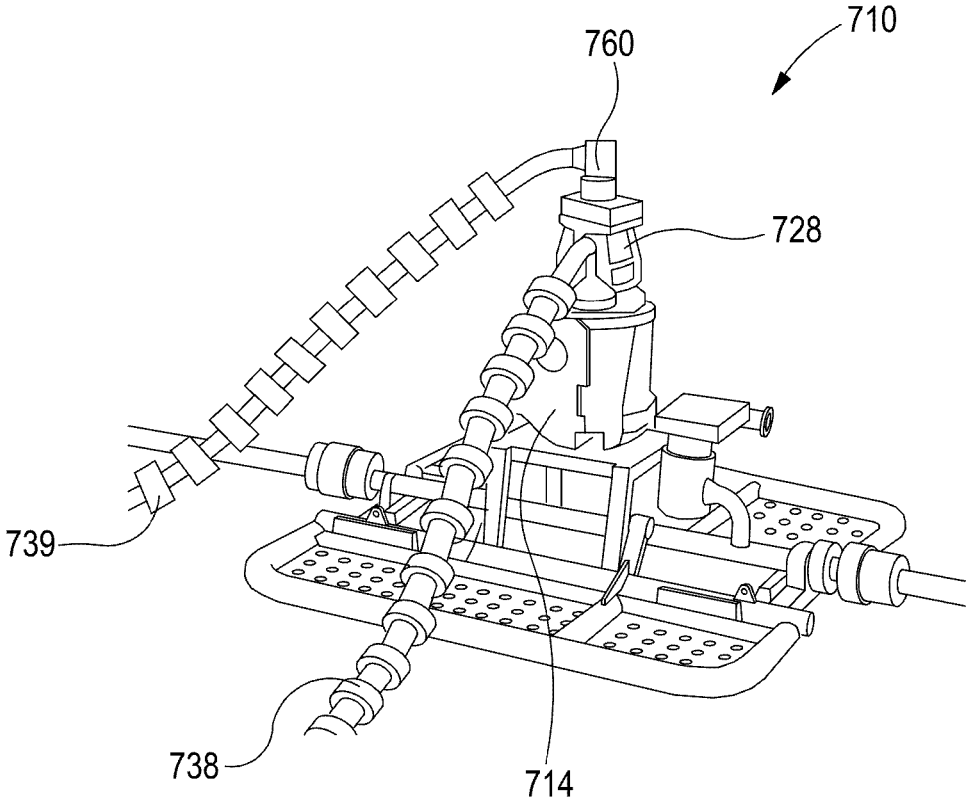
FIGS. 10A and 10B are perspective and schematic views, respectively, of an in-line tee arrangement according to an alternative embodiment of the invention.
Figure 10B:
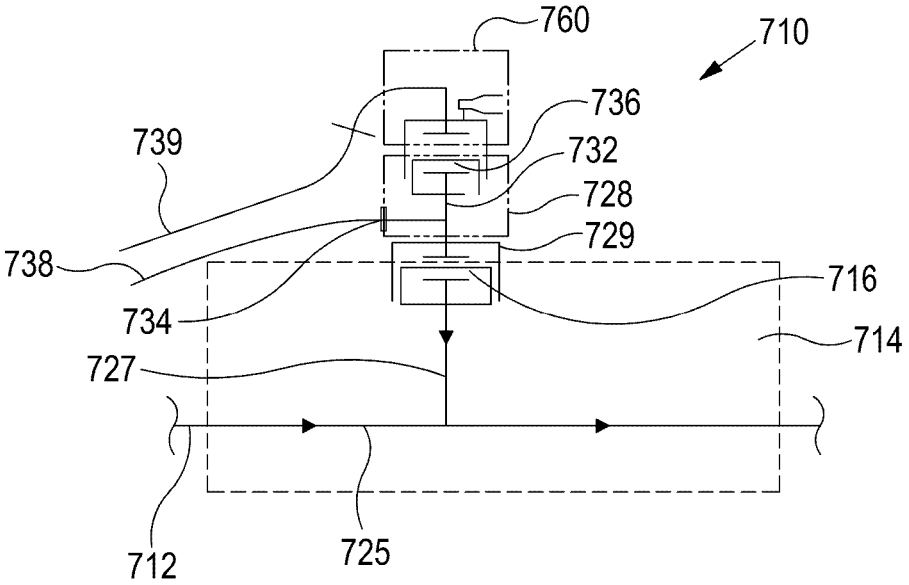

For example, FIGS. 10A and 10B are perspective and schematic views, respectively, of an in-line tee arrangement 710 having a single bore removable module 728 connected to an in-line tee 714. The single bore removable module 728 defines a flow path 732 between a lower connector 729 and a single bore interface 736. It also comprises a branched flow path between the flow path 732 and connector 734. Aa jumper flowline 738 is shown in connection with the removable module 728 such that the in-line tee arrangement can receive production flow from a tied-in subsea well (not shown).

This embodiment also differs from those previously described in that the interface of the removable module is not connected to a process apparatus. Instead, the single bore interface 736 is connected to a further jumper flowline 739 via a jumper flowline connector 760. In this embodiment, the in-line tee arrangement 710 is therefore operable to receive fluid from multiple subsea wells (not shown) via jumper flowlines 738 and 739. It will be appreciated that in alternative arrangements, a single bore module of this type can alternatively be used to facilitate connection of the in-line tee to a process apparatus, such as a single bore process apparatus.

Figure 11A:
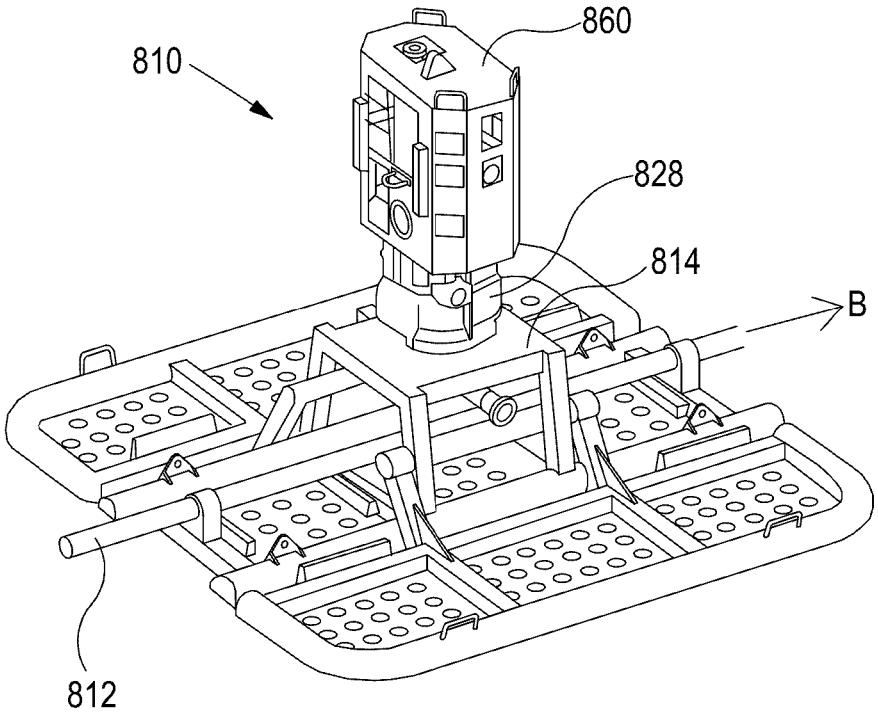
FIGS. 11A and 11B are perspective and schematic views, respectively, of an in-line tee arrangement according to an alternative embodiment of the invention.
Figure 11B:
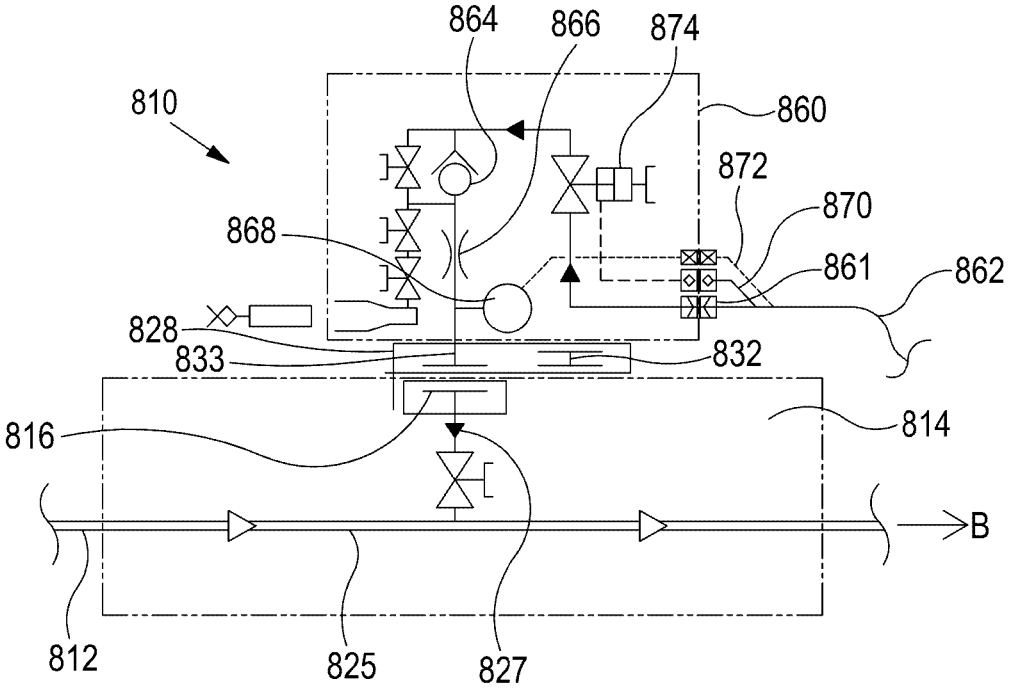

Alternatively, FIGS. 11A and 11B are perspective and schematic views, respectively, of an in-line tee arrangement 810 having a dual bore removable module 828 connected to an in-line tee 814. However, as only one of the flow bores 833 of the module 828 is utilised in this configuration, it effectively functions as a single bore module. It will be appreciated that a single bore module could be used.

The in-line tee arrangement is integrated into the pipeline 812, and receives flow in the direction of the arrows shown. The pipeline 812 is connected to a production riser, into which flow is routed upon its exit from the in-line tee 814 in the direction shown by arrow B. In the embodiment of FIGS. 11A and 11B, the branched tie-in point 816 is not connected to an additional subsea well. Instead, this point is utilised as an access location to the pipeline 812 to facilitate the performance of riser gas lift operations.

A retrievable gas lift apparatus 860 is connected to a single bore 833 of the module interface. However, it will be appreciated that alternative apparatus may connect to both bores, or multiple bores where provided by the interface. The gas lift apparatus 860 comprises an inlet 861 for one or more gas lift delivery lines 862. An injection check valve 864 and an injection nozzle 866 to control injection of gas from the delivery line(s) 862 and into the main flowline 825 of the in-line tee, where it mixes with production flow from the pipeline 812. The injected gas decreases the density of the production flow exiting the in-line tee, thus aiding and/or increasing recovery up the riser.

The apparatus 860 also comprises a pressure and temperature transducer (PTT) 868 to measure characteristics of the fluid within the apparatus 860. The PTT receives electrical power from a line 872 from an umbilical (not shown). Likewise, a valve 874 which controls the inlet of gas into the system is hydraulically actuated, with hydraulics provided from a line 870 from the umbilical.

Figure 12:
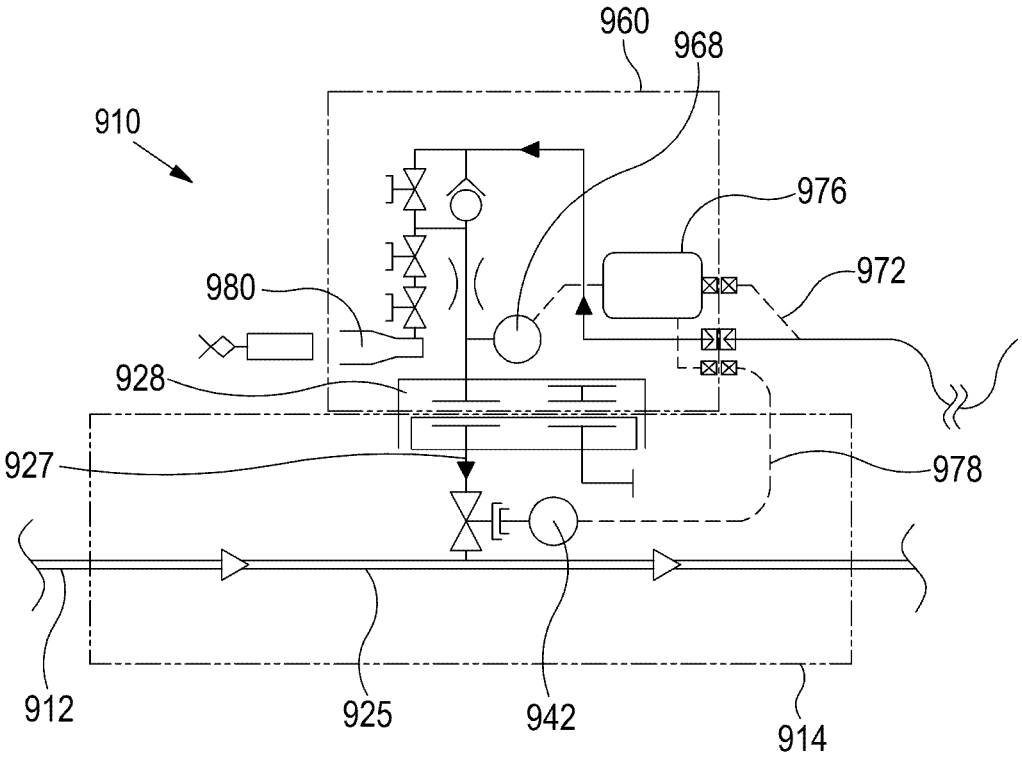
FIG. 12 is a schematic view of an in-line tee arrangement according to an alternative embodiment of the invention.

With reference now to FIG. 12, the in-line tee arrangement 910 is similar to the arrangement 810, and like components are indicated by like reference numerals incremented by 100. The arrangement 910 differs from 810 in that there is no hydraulically actuated valve to control the inlet of gas into the system. Instead, the isolation valve 942 within the branched flowline 927 of the in-line tee 914 is connected, by an electrical line 978, to an electrical module contained within the gas lift apparatus 960. A subsea electronics module receives electrical power from a line 972 from an umbilical (not shown) and operates the valve 942 and PTT 968.

In addition, a hydraulic intervention point is provided via a hot stab receptacle 980 in the apparatus 960.

Figure 13B:
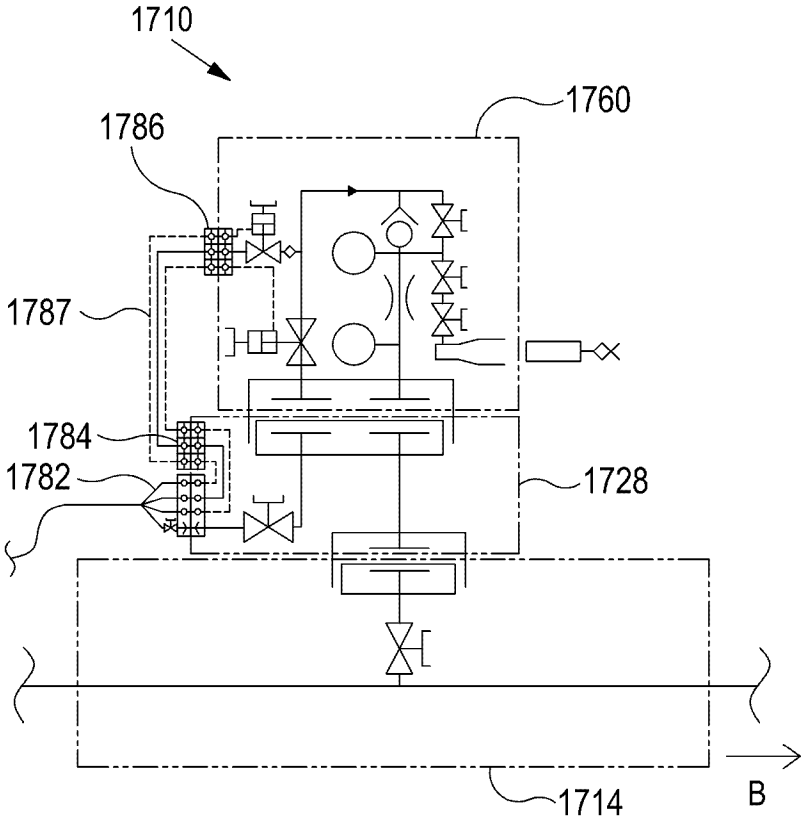
FIGS. 13A and 13B are schematic views of an in-line tee arrangement according to an alternative embodiment of the invention.
Figure 13A:
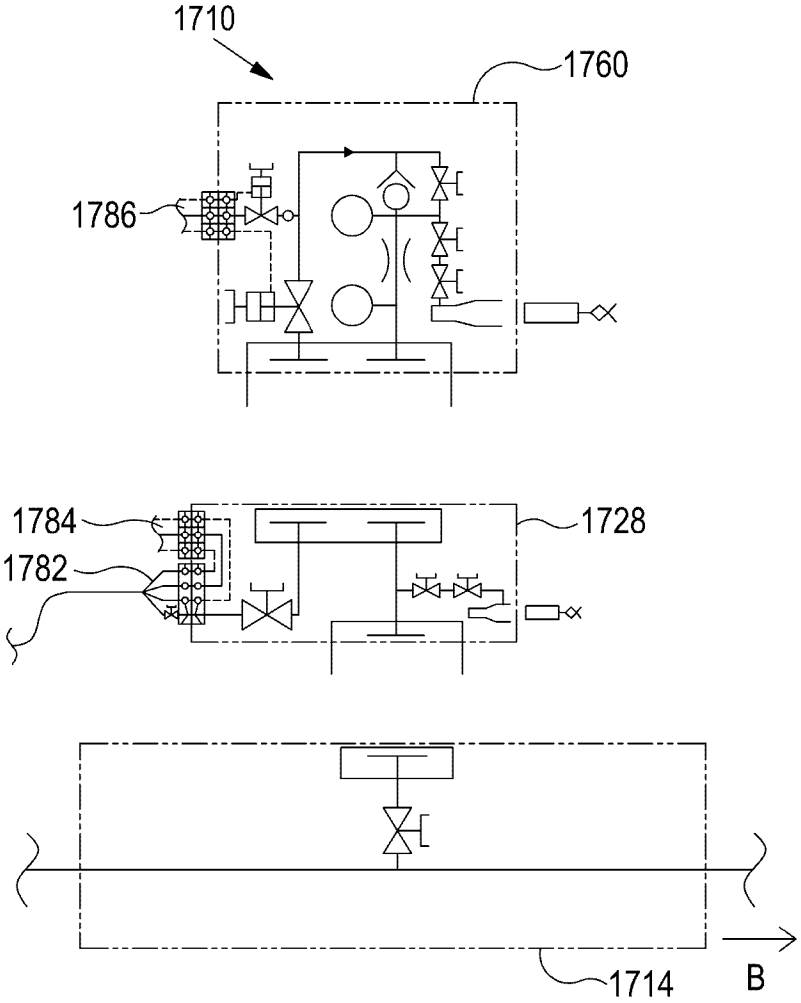

FIGS. 13A and 13B show an alternative gas lift in-line tee arrangement, generally at 1710, in exploded and assembled form, respectively. In this embodiment, a dual bore removable module 1728 is positioned on the in-line tee 1714. A gas lift apparatus 1760 is provided on the removable module 1728.

Like the in-line tees described in the foregoing description, the in-line tee 1714 is a stripped back and simplified in-line tee structure, which is devoid of the instrumentation and valving which is typically required for its use with any subsea flow system. The removable module 1728 facilitates connection of the gas lift apparatus 1760 to the tee 1714.

In this embodiment, the removable module 1728 is additionally provided with an interface 1782 to connect with an umbilical termination head (UTH) (not shown) to fluidly connect incoming gas lift and hydraulic control lines to corresponding lines provided within the module 1728. The interface 1782 may also facilitate connection to chemical lines containing methanol, for example. The module 1728 comprises a second outgoing interface 1784 for onward connection to a corresponding interface 1786 on the gas lift apparatus 1760, when installed upon the module 1728. When the second interface 1784 is unconnected, the fluids within the control lines are fully isolated by the removable module.

This arrangement of the removable module 1728 is beneficial because the interface 1782 allows the removable module to be installed upon the tee 1714 and connected to the various hydraulic and gas lift lines in the first instance. Then, when the gas list apparatus 1760 is installed (if and when required in the future), it is simply be connected to the outgoing interface 1784 of the module 1728 using the necessary lines 1787, instead of having to be connected to the UTH.

The gas lift apparatus 1760 is fully retrievable from the removable module 1728, such that the installed in-line tee 1714 is undisturbed during its recovery, replacement or change out (for example, for a variety kind of gas lift apparatus).

Although an orifice is shown as the gas lift nozzle, it will be appreciated that in alternative embodiments a choke valve could be used. In addition, the provision of transducers, other instrumentation and valving within the module can vary without materially effecting the function of the gas lift apparatus and operation.

In operation, the removable module 1728 receives gas from the gas delivery line via the interface 1782 and routes this to the gas lift apparatus 1760 via the interfaces 1784 and 1786. Gas is injected into the production pipeline in the same manner as described with reference to FIGS. 11A, 11B and 12, and the flow is routed into a production riser upon its exit from the in-line tee 1714 in the direction shown by arrow B.

Figure 14:
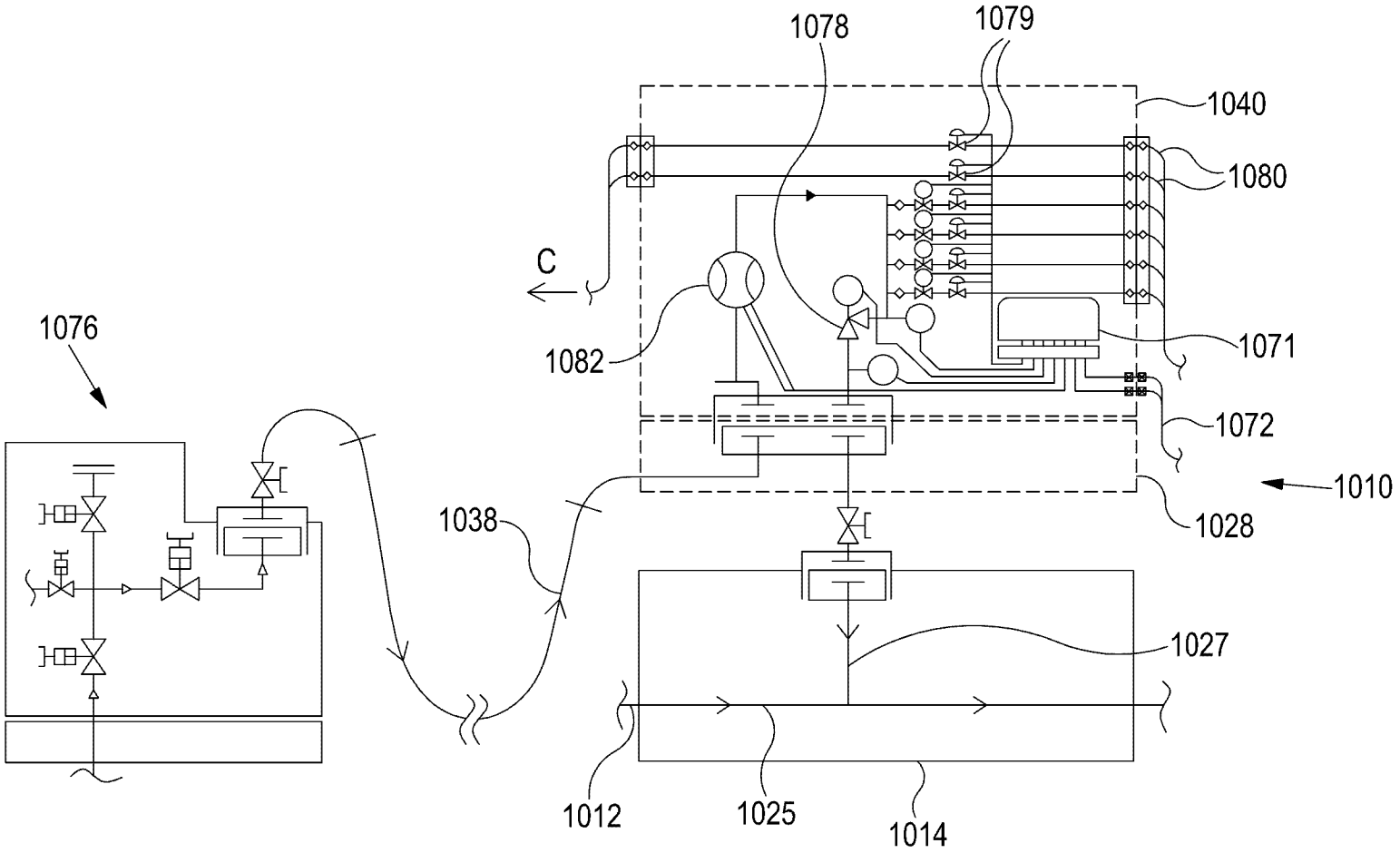
FIG. 14 is a schematic representation of a subsea flow system comprising an in-line tee arrangement according to an embodiment of the invention.

FIG. 14 includes additional features of the subsea flow system, including a subsea Christmas tree shown generally at 1076, to provide an example of how a subsea Christmas tree and a subsea in-line tee may be operated together to share functional elements. The in-line tee arrangement 1010 is similar to the arrangement 210, and like components are indicated by like reference numerals incremented by 800. Although not shown, it will be appreciated that the in-line tee 1014 may comprise an isolation valve in the branched flow path 1027.

The in-line tee apparatus 1010 is connected to a process apparatus 1040. In this embodiment of the invention, the process apparatus 1040 is a production choke and metering module. The production choke 1078 is displaced from the Christmas tree and instead provided in the apparatus 1040. Therefore, the in-line tee arrangement 1010 is capable of supporting the production choke 1078 required by the Christmas tree. In addition, the apparatus 1040 contains a pair of chemical injection throttle valves 1079 which control the flow of chemical injection fluid from fluid delivery lines 1080 through the apparatus 1040 and onward to the Christmas tree in the direction of arrow C. The apparatus 1040 also contains a flowmeter 1082 for production fluid. A subsea electronics module 1071 receives electrical power from a line 1072 from an umbilical (not shown) and operates the numerous valves, sensors and meters contained within the apparatus 1040. In operation, fluid which is produced from a subsea well (not shown) is routed into a subsea Christmas tree 1076. Fluid exits the Christmas tree via a jumper flowline 1038. The jumper flowline is connected to the removable module 1028 of the in-line tee arrangement 1010 such that production fluid flows into the removable module 1028 from the jumper flowline 1038. Flow is then routed through the production flow meter and choke apparatus 1040, in which any desired flow monitoring and/or control steps may be performed. Upon exiting the apparatus 1040, flow re-enters the removable module 1028 before being routed through the in-line tee 1014 to commingle with production fluid from one or more wells in the main production pipeline 1012.

Figure 15:
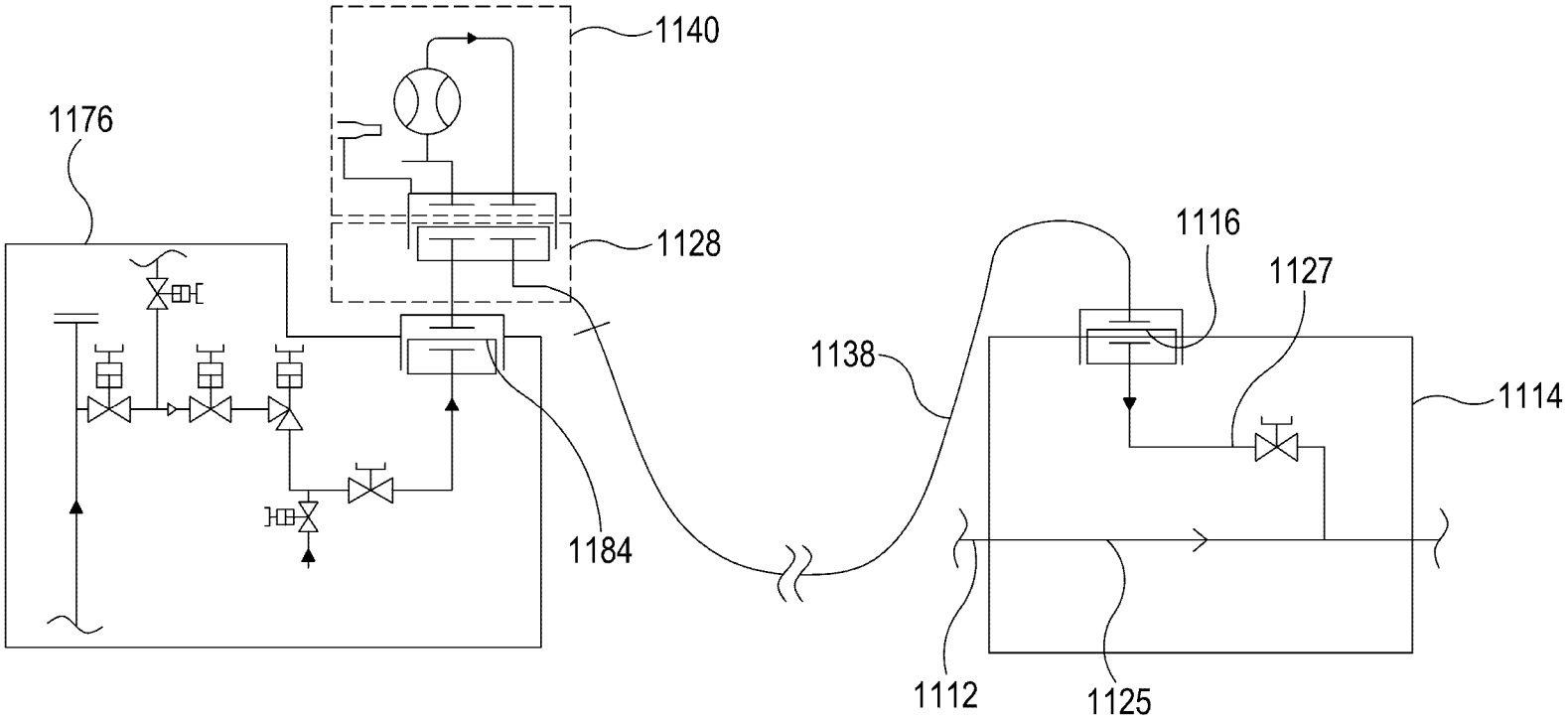
FIG. 15 is a schematic representation of a subsea flow system comprising an in-line tee arrangement according to an alternative embodiment of the invention.
Figure 16:
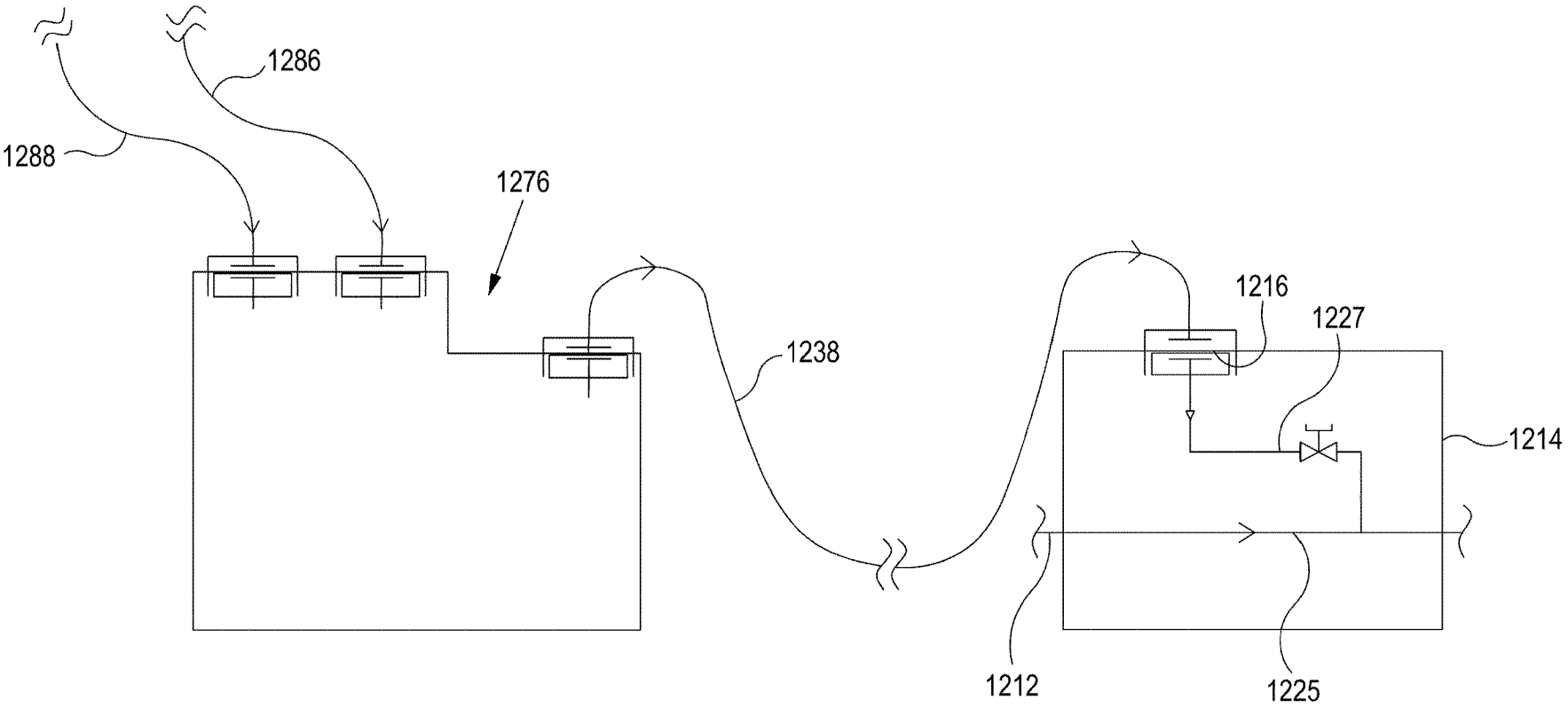
FIG. 16 is a schematic representation of a subsea flow system comprising an in-line tee arrangement according to a further alternative embodiment of the invention.

FIGS. 15 and 16 are also examples of how a subsea Christmas tree or a subsea manifold are arranged together in a flow system with a subsea in-line tee arrangement. With reference to FIG. 15, the removable module 1128 is located on an external flowline connector 1184 of subsea the Christmas tree 1176 instead of being provided on the branched tie-in point 1116 of the in-line tee 1114. A process apparatus 1140, which in this case is a metering module, is shown connected to the removable module 1128. The removable module is linked to the branched tie-in point 1116 of the in-line tee 1114 by a jumper flowline 1138. FIG. 15 serves as an additional example of the flexibility of the in-line tee system, as by utilising the removable module 1128, the process apparatus 1140 becomes independently retrievable from the Christmas tree or the in-line tee. In alternative embodiments, both the tree 1176 and the in-line tee 1114 are provided with removable modules and/or process apparatus landed thereon.

In the embodiment shown in FIG. 16, a subsea manifold 1276 receives production fluid from two subsea wells via subsea Christmas trees (not shown) and jumper flowlines 1286 and 1288. Production fluid is commingled within the manifold 1276 and directed into a single flow path. The production fluid exits the manifold 1276 via a jumper flowline 1238, which is connected at its opposite end to the branched tie-in point 1216 of a subsea in-line tee 1214. Production fluid is routed through the in-line tee 1214 to commingle with the production fluid from yet more wells in the main production pipeline 1212.

Figure 17A:
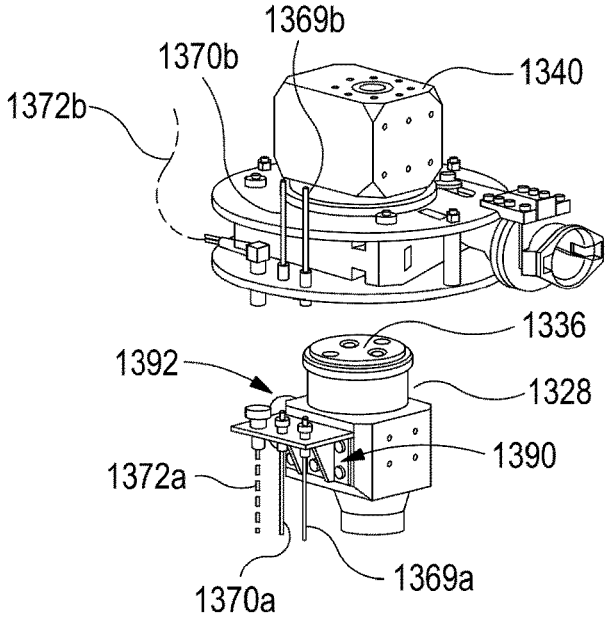
FIGS. 17A and 17B are perspective views of a removable module according to an embodiment of the invention.
Figure 17B:
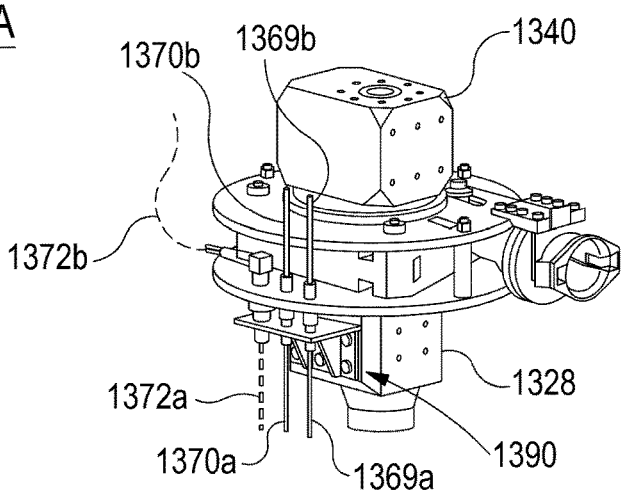
Figure 17C:
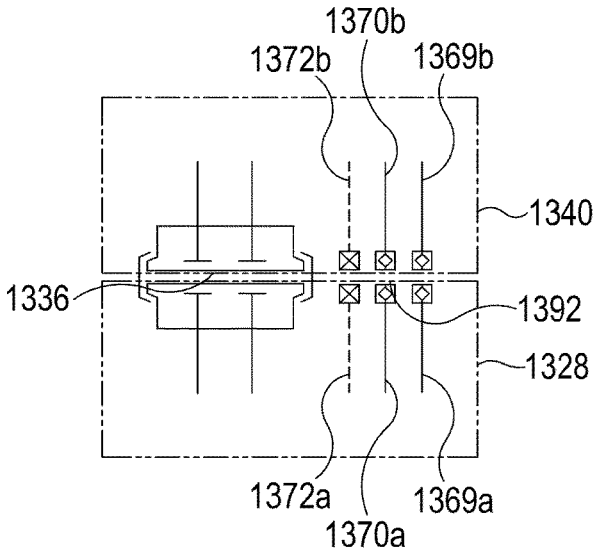
FIG. 17C is a schematic representation of the same.

Referring now to FIGS. 17A, 17B and 17C, perspective and schematic views of a removable module 1328 having pre-installed electrical and hydraulic supply lines are shown. The removable module 1328 can be connected to a pre-installed in-line tee, subsea Christmas tree or subsea manifold in the same manner as described above; however, the removable module 1328 differs from those previously described in that it comprises electrical and hydraulic supply lines affixed to it via a plate and bracket arrangement 1390. Two hydraulic lines 1369*a*, 1370*a* and one electrical line 1372*a* are provided on the removable module 1328 and are supplied from an umbilical (not shown). The removable module 1328 of FIGS. 17A to 17C therefore defines a control interface 1392 to provide electrical and hydraulic control to a process apparatus connected to the interface 1336 of the removable module 1238. The control interface is made up of electrical connectors and hydraulic couplings having integrated check valves therein. It will be appreciated that alternative types of control could be provided in the same, or a similar, manner. For example, the removable module may comprise fibreoptic control lines similarly connected from an umbilical.

A process apparatus 1340 comprising two hydraulic lines 1369*b*, 1370*b* and one electrical line 1372*b* is shown before and after connection to the removable module 1328. These lines 1369*b*, 1370*b*, 1372*b* are connected to the control interface 1392 of the module 1328 to receive hydraulic and electrical control. The lines 1369*b*, 1370*b*, 1372*b* may be utilised by the process apparatus 1340 itself, and/or may be directed towards a further piece of equipment or subsea infrastructure.

Providing a removable module that is pre-installed with control lines is beneficial as this reduces the need to carry out additional installation steps in the future. For example, the pre-installed control lines mean that a process apparatus which requires such control can simply be connected to the removable module and to the control supply lines in one step. In contrast, where a removable module does not comprise control lines pre-installed, connection of a process apparatus to the removable module and to separate control lines from a control umbilical will require additional installation steps.

Figure 18:
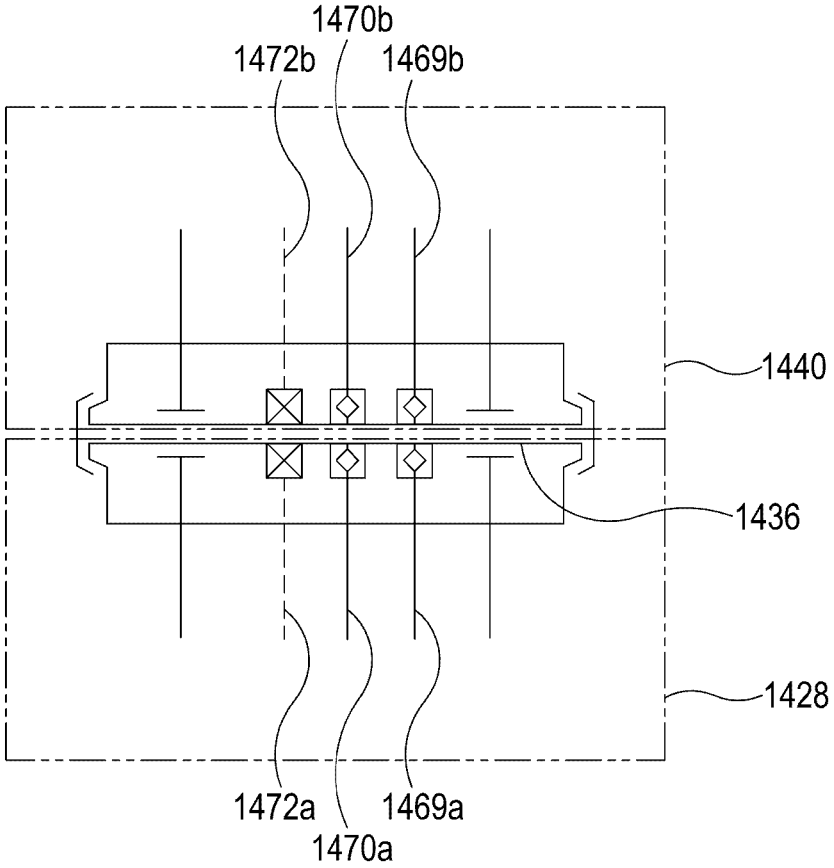
FIG. 18 is a schematic representation of a removable module according to an alternative embodiment of the invention.

The removable module 1428 of FIG. 18 is similar to the removable module 1328 of FIGS. 17A to 17C with like components indicated by like reference numerals incremented by 100. The removable module 1428 differs from the removable module 1328 in that instead of being externally affixed to the removable module, the control lines 1469*a*, 1469*b*, 1469*c* are integrated into the body of the removable module 1428. As such, the removable module 1428 defines a combined interface 1436 having integrated control connections and couplings.

The removable module may be utilised as a spacer module having the purpose of providing a spacer between the tee and another flow component, such as a jumper flowline or process apparatus. This type of module may be required for flowline and/or flow system geometry reasons.

Figure 19A:
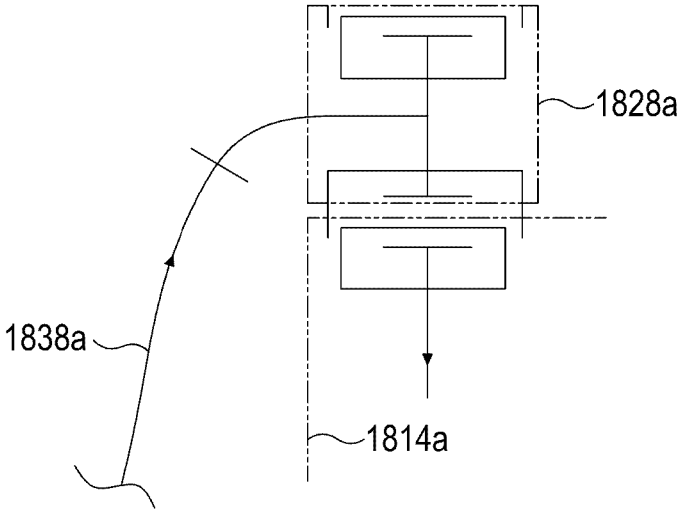
FIGS. 19A to 19C are schematic representations of removable modules according to respective alternative aspects of the invention.
Figure 19B:
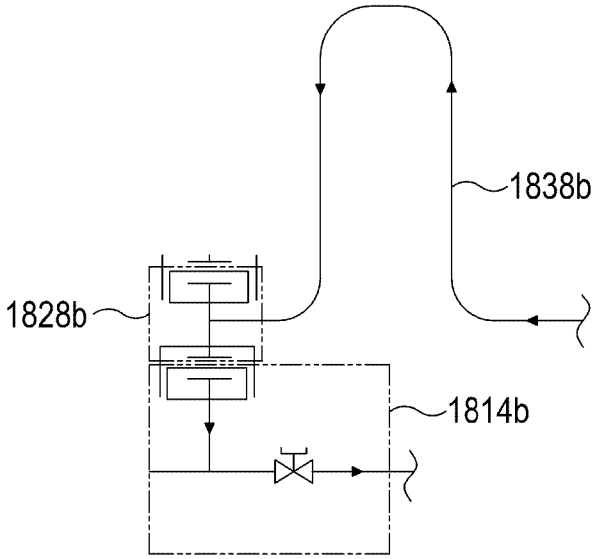
Figure 19C:
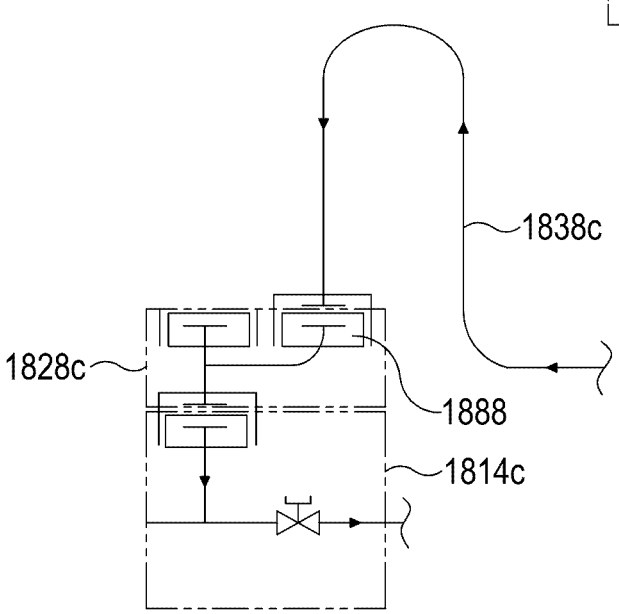

FIGS. 19A to 19C show alternative configurations of an in-line tee arrangement, in which a single bore removable module 1828*a*, 1828*b*, 1828*c* is provided on the in-line tee 1814*a*, 1814*b*, 1814*c*, respectively. In the configurations shown, a subsea well can be connected to the flow system via the module.

FIG. 19A shows a subsea well being connected to the system via a flexible jumper flowline 1838*a*. FIG. 19B alternatively shows a well being connected via a rigid jumper flowline 1838*b*. The modules can also be connected to composite flowlines or jumper flowlines, or a combination of flexible, rigid and composite jumper flowlines. In both of FIGS. 19A and 19B, the jumper flowlines are connected to the modules horizontally (i.e. to a connector oriented with its axis in a horizontal plane).

In the configuration of FIG. 19C, the module provides a dedicated vertical connector 1888 (i.e. to a connector oriented with its axis in a vertical plane) for the jumper flowline 1838*c*, to receive flow from a well.

Sensors, such as temperature and/or pressure sensors or additional instrumentation may also be provided in any of the retrievable modules described in the foregoing description, in communication with the main flow bore or bores therein. It will also be appreciated that any of the in-line tees described within this specification may be provided with an isolation valve operable to close off the branched tie-in flow path or paths.

The invention provides a subsea in-line tee arrangement for a subsea production system comprising a simplified in-line tee and a removable module and methods of installation and use. The arrangement has the capability to provide greater functionality to the in-line tee via retrievable process apparatus, whilst allowing the in-line tee to be reduced in size and weight; factors which simplify the installation of the pipeline into which the in-line tee is integrated and which reduce any damage caused to the pipeline by the in-line tee during installation. As the simplified in-line tee is smaller than typical in-line tees, it will be easier to weld (or otherwise connect) the tee into the pipeline before it is deployed subsea. This will be beneficial to the spatial constraints of pipe-lay vessels. Similarly, the smaller size of the simplified in-line tee will allow it to get through tensioners onboard the pipe-lay vessels without any issues.

The invention provides a subsea in-line tee arrangement for a subsea production system comprising at least one removable module. At least one retrievable process apparatus can be connected to the retrievable module. The at least one retrievable process apparatus is configured to perform a function selected from the group comprising: fluid control, fluid sampling, fluid diversion, fluid recovery, fluid injection, fluid circulation, fluid measurement and/or fluid metering.

Various modifications to the above-described embodiments may be made within the scope of the invention, and the invention extends to combinations of features other than those expressly claimed herein.

The invention claimed is:

1. A subsea in-line tee arrangement configured to be located in a pipeline of a subsea production system, the subsea in-line tee arrangement comprising:

a subsea in-line tee; and a removable module;

wherein the removable module comprises at least one connector for connecting the module to the in-line tee and an interface for connecting the module to at least one process apparatus;

wherein the removable module defines a first flow path between the at least one connector and the interface for routing production fluid to the in-line tee;

wherein the removable module comprises a second flow path for routing production fluid from a subsea well to the interface; and wherein the removable module is configured to be assembled with a jumper flowline and provide flow access between a jumper flowline and the subsea in-line tee.

2. The subsea in-line tee arrangement according to claim 1, wherein the in-line tee comprises an isolation valve.

3. The subsea in-line tee arrangement according to claim 1, wherein the removable module comprises an isolation valve.

4. The subsea in-line tee arrangement according to claim 1, wherein the interface of the removable module is configured to receive a process apparatus and/or multiple process apparatus.

5. The subsea in-line tee arrangement according to claim 1, wherein the at least one connector of the removable module is a first connector, wherein the removable module further comprises a second connector, and wherein the second flow path is defined between the second connector and the interface.

6. The subsea in-line tee arrangement according to claim 5, wherein the second connector is configured to connect the module to a jumper flowline.

7. The subsea in-line tee arrangement according to claim 1, wherein the interface is a dual bore interface.

8. The subsea in-line tee arrangement according to claim 1, wherein the interface is a multi-bore interface.

9. The subsea in-line tee arrangement according to claim 1, wherein the removable module comprises one or more control lines selected from the group comprising: hydraulic, electrical and/or fibreoptic control lines.

10. The subsea in-line tee arrangement according to claim 9, wherein the removable module comprises a control interface connected to the one or more control lines and configured to connect to a corresponding control interface of a process apparatus.

11. The subsea in-line tee arrangement according to claim 9, wherein the one or more control lines are connected to and supplied from an umbilical.

12. The subsea in-line tee arrangement according to claim 9, wherein the one or more control lines are integrated internally within the removable module.

13. The subsea in-line tee arrangement according to claim 1, wherein the interface of the removable module is configured to be connected to a process apparatus configured to perform one or more functions selected from the group comprising: fluid control, fluid sampling, fluid diversion, fluid recovery, fluid injection, fluid circulation, fluid access, fluid measurement, flow measurement, fluid metering and/or gas lift operations.

14. A subsea in-line tee installation located in a subsea production pipeline of a subsea production system, the installation comprising:

a subsea in-line tee integrated into a subsea production flowline;

a removable module assembled with a jumper flowline; and at least one process apparatus;

wherein the removable module comprises at least one connector connecting the module to the in-line tee and an interface connecting the module to the at least one process apparatus;

wherein the removable module defines a first flow path between the at least one connector and the interface for routing production fluid to the in-line tee and a second flow for routing production fluid from a subsea well to the interface; and wherein the removable module provides flow access between the jumper flowline and the subsea in-line tee.

15. The subsea in-line tee installation according to claim 14, wherein the process apparatus comprises a choke valve.

16. The subsea in-line tee installation according to claim 14, wherein the at least one process apparatus is configured to perform one or more functions selected from the group comprising: fluid control, fluid sampling, fluid diversion, fluid recovery, fluid injection, fluid circulation, fluid access, fluid measurement, flow measurement, fluid metering and/or gas lift operations.

17. A method of installing a removable module to a pre-installed subsea in-line tee, the method comprising:

providing a subsea in-line tee pre-installed into a subsea production system and comprising a connector;

providing a removable module comprising at least one connector and an interface for connecting the module to at least one process apparatus, wherein the removable module defines a first flow path between the at least one connector and the interface for routing production fluid to the in-line tee and a second flow path for routing production fluid from a subsea well to the interface, and wherein the removable module is assembled with a jumper flowline and is configured to provide flow access between the jumper flowline and the subsea in-line tee;

deploying the removable module subsea; and coupling the at least one connector of the removable module to the connector of the subsea in-line tee.

18. The method according to claim 17, wherein the connector of the in-line tee is connected to a pre-installed flow component and wherein the method comprises carrying out the step of removing the pre-installed flow component from the connector of the subsea in-line tee before the removable module is coupled to the in line tee.

19. The method according to claim 18, wherein the pre-installed flow component is a flow cap.

20. The method according to claim 17, wherein the at least one connector is a first connector and the removable module comprises a second connector coupled to a jumper flowline and forming a jumper flowline and removable module assembly.

21. The method according to claim 20, wherein the method comprises coupling the removable module and jumper flowline assembly to the connector of the subsea in line tee.

22. The method according to claim 17, wherein the method comprises connecting a process apparatus to the interface of the removable module.

* * * * *